US006876371B2

(12) United States Patent
Suzuki et al.

(10) Patent No.: US 6,876,371 B2
(45) Date of Patent: Apr. 5, 2005

(54) IMAGE FORMING APPARATUS

(75) Inventors: Takahiro Suzuki, Kanagawa (JP); Taketoshi Hoshizaki, Kanagawa (JP); Katsumi Nukada, Kanagawa (JP); Mitsuhide Nakamura, Kanagawa (JP); Kazuhiro Koseki, Kanagawa (JP); Takayuki Yamashita, Kanagawa (JP); Wataru Yamada, Kanagawa (JP); Koji Bando, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/683,273

(22) Filed: Oct. 14, 2003

(65) Prior Publication Data

US 2004/0183883 A1 Sep. 23, 2004

(30) Foreign Application Priority Data

Mar. 20, 2003 (JP) ..... 2003-078972

(51) Int. Cl.[7] ..... B41J 2/385; G03G 15/09; G03G 15/02

(52) U.S. Cl. ..... 347/118; 399/159; 430/58.2; 347/130

(58) Field of Search ..... 347/118, 129, 347/130; 399/159; 430/58.2, 56, 58.5, 59.6

(56) References Cited

U.S. PATENT DOCUMENTS 5,826,142 A * 10/1998 Takahashi et al. ..... 399/159
5,923,933 A * 7/1999 Anzai et al. ..... 399/269
6,403,270 B2 * 6/2002 Itami et al. ..... 430/59.5
6,416,915 B1 * 7/2002 Kikuchi et al. ..... 430/56
6,479,202 B2 * 11/2002 Shida et al. ..... 430/58.2
6,489,069 B1 * 12/2002 Itami et al. ..... 430/58.2
6,569,586 B2 * 5/2003 Itami et al. ..... 430/58.2
6,797,444 B2 * 9/2004 Itami ..... 430/58.2
2002/0076631 A1 * 6/2002 Itami et al. ..... 430/58.2
2003/0147670 A1 * 8/2003 Asano et al. ..... 399/223
2004/0062568 A1 * 4/2004 Nukada et al. ..... 399/159
2004/0126140 A1 * 7/2004 Azuma et al. ..... 399/159

FOREIGN PATENT DOCUMENTS

| | | |
|---|---|---|
| JP | 2002-6516 | 1/2002 |
| JP | 2002-123009 | 4/2002 |
| JP | 2002-182415 | 6/2002 |
| JP | 2002-268255 | 9/2002 |
| JP | 2002-341575 | 11/2002 |

* cited by examiner

*Primary Examiner*—Eugene H. Eickholt
(74) *Attorney, Agent, or Firm*—Oliff & Berridge, PLC

(57) ABSTRACT

The invention provides an image forming apparatus comprising at least: an electrophotographic photoreceptor comprising at least a conductive substrate and a photosensitive layer provided on the conductive substrate; a charging device; an exposure device; a developing device; and a transfer device, wherein the exposure device is of a multi beam exposure system which has a surface emitting laser array having two or more light-emitting elements as an exposure light source and which scan the electrophotographic photoreceptor with plural light beams thereby forming electrostatic latent image, and wherein the outermost layer in the electrophotographic photoreceptor, positioned most distant from the conductive substrate, contains a silicon-containing resin containing at least a charge transporting compound or a characteristic group derived from a charge transporting compound, and having a structure in which bonds formed by crosslinking of an O atom with neighboring Si atoms are formed three dimensionally.

20 Claims, 6 Drawing Sheets

IMAGE FORMING APPARATUS

FIELD OF THE INVENTION

The present invention relates to an image forming apparatus for effecting an image formation by an electrophotographic process including steps of charging, exposure, development, transfer etc. and adapted for use in a copying apparatus, a printer, a facsimile apparatus or the like.

BACKGROUND OF THE INVENTION

In an image forming apparatus of an electrophotographic process, for forming an electrostatic latent image on a charged electrophotographic photoreceptor, there is known a method of scanning the electrophotographic photoreceptor with plural light beams (hereinafter referred to as "multi-beam method"). The image forming apparatus of such multi-beam method is considered effective for achieving a higher speed in the image forming process, because of following advantages 1) to 3).

1) An image forming apparatus employing n laser beams (n being a natural number), with a scanning speed of the laser beam and a print speed selected same as those in the case of employing a single laser beam, can increase a density of scanning lines to n times, thereby achieving an image recording of a high resolution; 2) In the case of selecting the scanning speed of the laser beam and the density of the scanning lines same as those in the case of employing a single laser beam, the print speed can be increased to n times; 3) In the case of selecting the print speed and the scanning density of the laser beam same as those in the case of employing a single laser beam, it is possible to reduce the scanning speed of each laser beam (namely reducing, to 1/n times, a revolution of a rotary polygon mirror which reflects the laser beam to irradiate the electrophotographic photoreceptor thereby forming the electrostatic latent image thereon) whereby a mechanism for rotating the rotary polygon mirror can be simplified to achieve a cost reduction.

For the image forming apparatus of such multi-beam method, there is proposed an image forming apparatus in which plural laser beams are respectively deflected to simultaneously scan a scanned member such as an electrophotographic photoreceptor and an image is formed by scanning with plural scan lines in a single main scanning operation and which employs a surface emitting laser capable of easy array formation (VCSEL: vertical cavity surface emitting laser) as a light source of the exposure device and increases the number of simultaneously scanning laser beams (namely the number of scanning lines simultaneously scanned by laser beams) thereby achieving a higher quality of the image and a higher speed in image formation (see, for example, patent document 1).

On the other hand, in the image forming apparatus, there are being required not only a higher quality of the image and a higher speed of image formation, but also a downsized configuration and a longer service life for providing high-quality images over a prolonged period in stable manner. The service life of the image forming apparatus often depends on a service life of a photoreceptor employed therein, and such service life is known to result from a gradual deterioration of the image forming characteristics of the photoreceptor by mechanical and chemical actions in the course of repetition of charging, exposure, development, transfer and cleaning steps in the electrophotographic process.

It has been already known that the above-mentioned deterioration in the image quality by the chemical action is caused by the progress of oxidation of a binder resin and the progress of oxidation of a charge transport material in the photoreceptor by ozone generated in such repeated steps. It has also been known that the above-mentioned deterioration in the image quality by the mechanical action is caused by the progress of abrasion of the photoreceptor and/or the generation of scratches thereon, which are due to a deposit or the like generated in repeated steps of the electrophotographic process. Particularly, in the case where the photoreceptor is made smaller in diameter for the purpose of elevating the image forming speed and reducing the dimension of the apparatus, the photoreceptor is used under severer conditions in the repeated steps and the deterioration of the image quality by the mechanical action becomes conspicuous.

For example, in the case where a rubber blade is employed in the cleaning unit, a rubber material of a higher rubber hardness is employed for constituting the rubber blade in order to sufficiently clean the photoreceptor, thereby resulting in a higher contact pressure of the rubber blade to the photoreceptor and accelerating the abrasion thereof, whereby the photoreceptor shows a fluctuation in the potential or in the photosensitivity in the aforementioned repeated steps, leading to drawbacks of an abnormal image formation or a distorted color balance in the case of a color image formation.

In order to resolve such drawbacks, there are proposed technologies of forming a protective layer on the photosensitive layer of the photoreceptor or adding an inorganic filler in the photosensitive layer (see, for example, patent documents 2 to 7).

| | |
|---|---|
| Patent document 1: | JP 5-294005 A |
| Patent document 2: | JP 1-205171 A |
| Patent document 3: | JP 7-333881 A |
| Patent document 4: | JP 8-15887 A |
| Patent document 5: | JP 8-123053 A |
| Patent document 6: | JP 8-146641 A |
| Patent document 7: | JP 8-179542 A |

However, the present inventors found that the image forming apparatus of the background art employing the surface emitting laser as the light source of the exposure device, including the image forming apparatus described in the foregoing patent document 1, has been associated with a drawback that a light amount on the photoreceptor becomes deficient because of following two reasons.

Firstly, there cannot be obtained a sufficient light emission amount per a light emitting point, because of a small volume of a cavity in the surface emitting laser itself. Secondly, in order to obtain a desired beam diameter, on the photoreceptor, while utilizing a surface emitting laser array having closely positioned light emitting points, there has to be provided an aperture in the scanning optical system, whereby the light amount is reduced. Also for attaining a higher resolution in the formed image with such aperture, it is necessary to utilize a smaller aperture, which however further reduce the light amount.

Also the present inventors found that, in the image forming apparatus described in the foregoing patent documents 1 to 7, the configuration of forming a protective layer on the photosensitive layer of the photoreceptor or adding an inorganic filler in the photosensitive layer improves an abrasion resistance, but, in the case where the image formation is continuously repeated over a prolonged period, there has resulted a potential increase in an exposed portion of the photoreceptor, thus leading to an image deterioration such as a decrease in the image density, whereby an image of a satisfactory image quality cannot be obtained. In particular, the present inventors found that the protective layer described in the patent document 7 has a high mechanical strength and improves the abrasion resistance but deteriorates the resolution of the image, showing thicker lines in a character image and being inadequate for attaining high image quality.

In this manner, in the image forming apparatus of the background art employing an exposure device with a scanning optical system utilizing a surface emitting laser array as the light source, it has been difficult to achieve downsizing of the apparatus and a higher image forming speed and, at the same time, to attain a higher quality (higher resolution) in the formed image and to maintain such image quality in a satisfactory state over a prolonged period.

For example, in order to achieve higher image quality, it is preferred a thinner photosensitive layer, which however shows a remarkable deterioration of the image quality resulting from the abrasion of the photoreceptor in the repeated use over a prolonged period. Particularly, in the image forming apparatus of the background art employing a surface emitting laser array as the light source, since the exposure light amount is relatively low as explained in the foregoing, even a slight abrasion of the photoreceptor results in a fluctuation in the potential and photosensitivity of the photoreceptor, particularly in a low sensitivity. Also in the case where the photoreceptor is made smaller in diameter in order to achieve downsizing of the image forming apparatus, the abrasion of the photoreceptor tends to be accelerated to limit the service life thereof, as it generally becomes necessary to employ a charger of contact type and the number of image forming cycles generally increases.

SUMMARY OF THE INVENTION

The present invention has been made in consideration of the drawbacks of the above-described background technologies.

Accordingly, an object of the invention is to provide an image forming apparatus which is, even in the case of employing a surface emitting laser array as the light source of the exposure device, capable of easily realizing an improvement in the image quality, a higher image forming speed and downsizing of the apparatus, and also capable of providing images of satisfactory quality even after repeating the image forming process over a prolonged period.

Other objects and effects of the invention will become apparent from the following description.

As a result of extensive investigations for attaining the above-mentioned objectives, the present inventors found it extremely effective for attaining the above-mentioned objectives, to incorporate at least the specific silicon-containing resin mentioned below in an outermost layer, provided at the most distant position from the conductive substrate, of the electrophotographic photoreceptor, or to construct an outermost layer, provided at the most distant position from the conductive substrate, so as to have an abrasion rate satisfying the specific condition shown below. The present invention has been made based on these findings.

More specifically, the invention provides an image forming apparatus comprising at least:

an electrophotographic photoreceptor comprising at least a conductive substrate and a photosensitive layer provided on the conductive substrate;

a charging device for charging the electrophotographic photoreceptor;

an exposure device for exposing the electrophotographic photoreceptor charged by the charging device to light thereby forming an electrostatic latent image;

a developing device for developing the electrostatic latent image with toner thereby forming a toner image; and a transfer device for transferring the toner image from the electrophotographic photoreceptor to a transferred image-receiving medium, wherein the exposure device is of a multi beam exposure system which has a surface emitting laser array having two or more light-emitting elements as an exposure light source and which scans the electrophotographic photoreceptor with plural light beams thereby forming the electrostatic latent image, and wherein the outermost layer in the electrophotographic photoreceptor, positioned most distant from the conductive substrate, contains a silicon-containing resin containing at least a charge transporting compound or a characteristic group derived from a charge transporting compound, and having a structure in which bonds formed by crosslinking of an O atom with neighboring Si atoms are formed three dimensionally.

The invention also provides an image forming apparatus comprising at least:

an electrophotographic photoreceptor comprising at least a conductive substrate and a photosensitive layer provided on the conductive substrate;

a charging device for charging the electrophotographic photoreceptor;

an exposure device for exposing the electrophotographic photoreceptor charged by the charging device to light thereby forming an electrostatic latent image;

a developing device for developing the electrostatic latent image with toner thereby forming a toner image; and a transfer device for transferring the toner image from the electrophotographic photoreceptor to a transferred image-receiving medium, wherein the exposure device is of a multi beam exposure system which scans the electrophotographic photoreceptor with plural light beams thereby forming the electrostatic latent image, and wherein the outermost layer in the electrophotographic photoreceptor, positioned most distant from the conductive substrate, has an abrasion rate of 5 nm/kcycle or less.

The image forming apparatuses of the invention (the above-mentioned two types of apparatuses), employing a method of forming an electrostatic latent image with multiple beams, particularly a method of employing a surface emitting laser (VCSEL: vertical cavity surface emitting laser), easily formed into an array, as a light source and simultaneously scanning two or more lines with laser beams, allow to realize an improvement in the image quality and an increase in the image forming speed. In this case, it is also possible to increase a recording density.

The surface emitting laser can be easily formed into an array and light-emitting points can be arranged two-dimensionally with a high density. Therefore, a light source formed by such laser can easily realize a multi-beam configuration that is capable of emitting 10 or more laser beams at the same time.

In the case of splitting a single beam into pseudo plural beams by an acoustic element, an electrostatic latent image formed on the electrophotographic photoreceptor includes areas of different numbers of scanning (numbers of irradiation) with the light beam, and the difference in the number of irradiation between such areas may be observed as a streak-shaped density unevenness. Contrary, the use of a surface emitting laser array does not decrease the exposure time even when the number of the beams is increased, thereby sufficiently reducing the streak-shaped density unevenness and achieving higher image quality, and attaining at the same time a higher image forming speed.

Also, the image forming apparatuses of the invention (the above-mentioned two types of apparatuses), employing the configuration of providing the outermost layer, as a component of the photoreceptor, containing the aforementioned silicon-containing resin or having an abrasion rate of 5 nm/kcycle or less, can achieve a latent image formation on the photoreceptor without hindering a state capable of image writing of a high resolution with laser beams, followed by a development step and a transfer step, and also can sufficiently suppress the loss in the service life of the photoreceptor even in the case where the photosensitive layer is designed thin or becomes thin by the abrasion in the course of use.

Also, the configuration of providing the outermost layer, as a component of the photoreceptor, containing the aforementioned silicon-containing resin or having an abrasion rate of 5 nm/kcycle or less can sufficiently prevent fluctuations in the potential and sensitivity of the photoreceptor which are generated with the progress of the abrasion of the photosensitive layer, thereby compensating drawbacks of the surface emitting laser such as a limited variable range of the light amount and a narrow control width. Also, the image forming apparatus of the invention, allowing to employ a thinner photosensitive layer, can sufficiently suppress a loss in the image quality resulting from a charge diffusion at the formation of the electrostatic latent image.

The "abrasion rate" is based on an amount of decrease in the thickness of the outermost layer in a cycle of the electrophotographic process involving the electrophotographic photoreceptor, which process cycle is composed of charging, exposure, development, transfer and cleaning steps. 1 kcycle is 1000 cycles.

Therefore, the image forming apparatuses of the invention (the above-mentioned two types of apparatuses), even in the case of employing a surface emitting laser array as the light source of the exposure device, can easily achieve an improvement in the image quality, an increase in the image forming speed and downsizing of the apparatus, and can also provide images of satisfactory image quality even after repeating the image forming process over a prolonged period. For example, the image forming apparatus of the invention can even provide image quality of a high resolution showing a recording density of 1200 dot/inch or higher over a prolonged period.

In the case of the image forming apparatus mounted with a photoreceptor of which the outermost layer is adjusted to have an abrasion rate of 5 nm/kcycle or less (hereinafter referred to as "image forming apparatus B"), the outermost layer is not particularly restricted in its components or composition as long as the aforementioned abrasion rate is satisfied and it can be utilized for an exposing light to be used. However, for the purpose of attaining the effects of the invention more easily and more securely, it is preferred, as in the image forming apparatus of the invention of the other type (i.e., the image forming apparatus of a configuration providing an outermost layer containing the aforementioned silicon-containing resin as a component of the photoreceptor, which is hereinafter referred to as "image forming apparatus A"), to include the aforementioned silicon-containing resin in the outermost layer.

In the present invention, more specifically, even in the case of the image forming apparatus B, it is preferred that the outermost layer in the electrophotographic photoreceptor contains a silicon-containing resin containing at least a charge transporting compound or a characteristic group derived from a charge transporting compound and having a structure in which bonds formed by crosslinking of an O atom bonded with neighboring Si atoms are formed three dimensionally.

Also, for the purpose of attaining the effects of the invention more easily and more securely, in either of the image forming apparatus A and the image forming apparatus B, the outermost layer of the electrophotographic photoreceptor is preferably formed by the silicon-containing resin.

Further, for the same purpose, in either of the image forming apparatus A and the image forming apparatus B of the invention, the silicon-containing resin preferably contains at least one resin represented by the following general formula (1):

$$F^1[—D^1—Si(OR^2)_a(R^1)_{3-a}]_b \quad (1)$$

In formula (1), $F^1$ represents an organic group derived from a charge transporting compound; $D^1$ represents a divalent group (flexible sub-unit); $R^1$ represents one selected from the group consisting of a hydrogen atom, an alkyl group and a substituted or unsubstituted aryl group; $R^2$ represents one selected from the group consisting of a hydrogen atom, an alkyl group and a trialkylsilyl group; a represents an integer from 1 to 3; and b represents an integer from 1 to 4.

Also in the invention, in either of the image forming apparatus A and the image forming apparatus B, it is preferred that the surface emitting laser array has light emitting points arranged two-dimensionally. This makes it possible to easily increase the number of light beams which scan the electrophotographic photoreceptor, thereby more effectively increasing the image forming speed. Also for more securely attaining the effects of the invention, the surface emitting laser array has light emitting points arranged preferably in at least 3 rows by 3 columns, more preferably at least 6 rows by 6 columns, and further preferably at least 8 rows by 8 columns, thereby achieving higher image quality (higher resolution) and a higher speed.

Also in the invention, for more effectively increasing the image forming speed, in either of the image forming apparatus A and the image forming apparatus B, the exposure device preferably causes three or more light beams to independently scan the electrophotographic photoreceptor. For the purpose of more securely obtaining the effects of the invention, the number of the beams is preferably 5 or larger, more preferably 8 or larger, further preferably 10 or larger, further preferably 16 or larger, and further preferably 32 or larger.

Also the present inventors found that higher image quality and a longer service life can be compatibly achieved by limiting the sum of the thickness of the photosensitive layer (having a configuration preferably comprising at least a charge generation layer containing a charge generating material and a charge transport layer containing a charge transport material) and the thickness of the protective layer to a specified value or less. More specifically, in the invention, in either of the image forming apparatus A and the image forming apparatus B, it is preferred that the photosensitive layer has a configuration of at least including a charge generation layer containing a charge generating substance and a charge transport layer containing a charge transport material, that a protective layer constituted of the silicon-containing resin is further provided as the outermost layer on the photosensitive layer, and the sum of the thickness of the photosensitive layer and the thickness of the protective layer is 25 $\mu$m or less.

In the invention, the transfer of the toner image by the transfer device may be carried out directly from the photoreceptor to a paper (transferred image-receiving medium) or from the photoreceptor via an intermediate transfer member to the paper (transferred image-receiving medium).

DETAILED DESCRIPTION OF THE INVENTION

Preferred embodiments of the present invention will be described in more detail below with reference to the accompanying drawings. Same or equivalent components will be represented by same symbols and duplicating explanations will be omitted.

Figure 1:
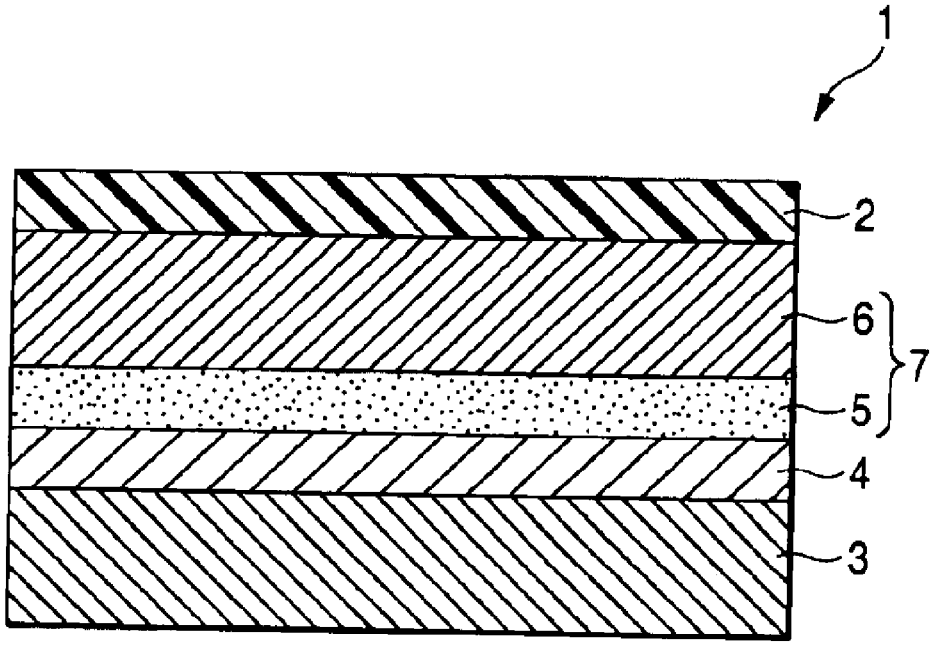
FIG. 1 is a schematic cross-sectional view showing an example of a preferred basic configuration of the electrophotographic photoreceptor to be mounted in the image forming apparatus of the present invention.

Firstly, there will be explained in detail a preferred embodiment of the image forming apparatus of the invention. FIG. 1 is a cross-sectional view showing a preferred basic configuration of the electrophotographic photoreceptor to be mounted in the image forming apparatus.

As shown in FIG. 1, an electrophotographic photoreceptor 1 is constituted of a conductive substrate 3, an undercoat layer 4 formed on the conductive substrate 3, a photosensitive layer 7 formed on the undercoat layer 4, and a protective layer 2 formed on the photosensitive layer 7. The photosensitive layer 7 has a laminated structure (two-layered structure) composed of a charge generation layer 5 formed on the undercoat layer 4 and a charge transport layer 6 formed on the charge generation layer 5.

The protective layer 2 is explained below. The protective layer 2 contains a silicon-containing resin explained below and is adjusted to have an abrasion rate of 5 nm/kcycle or less.

The protective layer 2 is the outermost layer provided for obtaining the aforementioned effects of the invention, and serves to prevent a chemical change in the photosensitive layer 7, etc. at a charging step and to further increase the mechanical strength of the photosensitive layer 7.

The protective layer 2 contains a silicon-containing resin containing at least a charge transporting compound or a characteristic group derived from a charge transporting compound and having a structure in which bonds formed by crosslinking of an O atom with neighboring Si atoms are formed three dimensionally.

In particular, the protective layer 2 is preferably formed by the silicon-containing resin.

As the silicon-containing resin, preferred is a resin formed by containing a charge transport compound (compound having a charge transporting property) and containing at least one resin represented by general formula (1) shown below, and the protective layer 2 is preferably a cured film formed from a resin containing at least one resin represented by general formula (1):

$$F^1[—D^1—Si(OR^2)_a(R^1)_{3-a}]_b \quad (1)$$

wherein $F^1$ represents an organic group derived from a charge transporting compound; $D^1$ represents a divalent group (flexible sub-unit); $R^1$ represents one selected from the group consisting of a hydrogen atom, an alkyl group and a substituted or unsubstituted aryl group; $R^2$ represents one selected from the group consisting of a hydrogen atom, an alkyl group and a trialkylsilyl group; a represents an integer from 1 to 3; and b represents an integer from 1 to 4.

The charge transport compound represented by $F^1$ is a photofunctional compound (i.e., a compound having an ability of transporting a photocarrier which is a positive hole or an electron).

In general formula (I), the part represented by $—Si(OR^2)_a(R^1)_{3-a}$ functions as a characteristic group having a hydrolyzable group (hereinafter referred to as "substituted silicon group"). The substituted silicon group, in the presence of another neighboring substituted silicon group, causes a mutual crosslinking reaction at the —Si— groups, thus forming a three-dimensional —Si—O—Si— bond, formed by crosslinking of an oxygen atom with neighboring —Si— groups. Thus, the substituted silicon group serves to form so-called inorganic glassy network in the protective layer 2.

In general formula (I), an organic group represented by $F^1$ is not particularly restricted as long as it has an ability of transporting a photocarrier which is a positive hole or an electron, and may have the same structure as that of already known charge transporting substances. More specifically, there can be employed compounds having a skeleton of a compound having positive hole transporting property, such as a triarylamine compound, a benzidine compound, an arylalkane compound, an aryl-substituted ethylenic compound, a stilbene compound, an anthracene compound or a hydrazone compound, or compounds having a skeleton of a compound having electron transporting property, such as a quinone compound, a fluorenone compound, a xanthone compound, a benzophenone compound, a cyanovinyl compound or an ethylenic compound.

In general formula (1), $D^1$ is a divalent group which functions as combining the group $F^1$ for providing the photoelectric property to the substituted silicon group contributing to the formation of the three-dimensional inorganic glass-like network. Also $D^1$ represents an organic group structure serving to provide the inorganic glass-like network, which is hard but is also brittle, with a suitable flexibility thereby improving the mechanical strength of the film (protective layer 2).

Specific examples of $D^1$ include divalent hydrocarbon groups represented by $—C_nH_{2n}—$, $—C_{n'}H_{2n'-2}—$, or $—C_{n''}H_{2n''-4}—$ (n being 1 to 15, n' being 2 to 15 and n'' being 3 to 15), —COO—, —S—, —O—, $—CH_2—C_6H_4—$, —N=CH—, $—(C_6H_4)—(C_6H_4)—$, characteristic groups having a structure of an arbitrary combination of these groups, and groups in which a constituent atom in those characteristic groups is substituted by another substituent.

In general formula (1), b is preferably 2 or larger. A value b equal to or larger than 2 corresponds to the presence of two or more Si atoms in the charge transport material represented by general formula (1), whereby the inorganic glass-like network can be formed easier and the mechanical strength is improved.

The compound represented by general formula (1) is preferably a compound represented by general formula (2) shown below. The compound represented by general formula (2) is a compound having a positive hole transporting function (positive hole transport material), and the inclusion of such substance in the protective layer 2 is preferred for improving the electrical characteristics and mechanical strength of the protective layer 2.

(2)

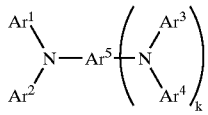

In general formula (2), $Ar^1$ to $Ar^4$, which may be same or different, each independently represents a substituted or unsubstituted aryl group; $Ar^5$ represents a substituted or unsubstituted aryl or arylene group; k represents 0 or 1; and, among $Ar^1$ to $Ar^5$, one to four characteristic groups have a structure represented by the following general formula (3).

$$—Y^1—Si(OR^2)_aR^1_{3-a} \quad (3)$$

In general formula (3), a, $R^1$ and $R^2$ have respectively the same meanings as those in formula (1), and $Y^1$ represents a divalent group.

Specifically, $Y^1$ represents a divalent group selected from the group consisting of divalent hydrocarbon groups represented by $—C_\alpha H_{2\alpha}—$, $—C_{\alpha'}H_{2\alpha'-2}—$ or $—C_{\alpha''}H_{2\alpha''-4}—$ ($\alpha$ being an integer from 1 to 15, $\alpha'$ being an integer from 2 to 15; and $\alpha''$ being an integer from 3 to 15), substituted or unsubstituted divalent aryl groups, —N═CH—, —O—, and —COO—. Also $Y^1$ may be a characteristic group having a structure of an arbitrary combination of divalent groups selected from the foregoing groups.

In the foregoing general formula (2), each of $Ar^1$ to $Ar^5$ is preferably one of groups represented by following formulas (4) to (10):

(4)

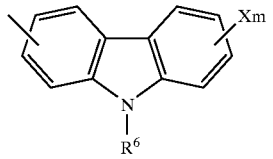

(5)

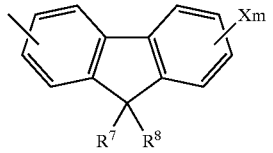

-continued (6)

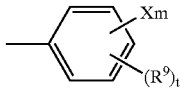

(7)

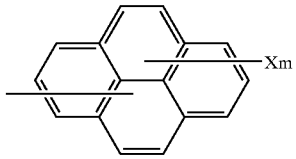

(8)

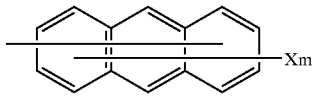

(9)

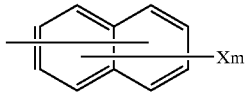

$$—Ar—Z'_s—Ar—X_m \quad (10)$$

In formulas (4) to (10), $R^6$, $R^7$ and $R^8$ each represents one selected from the group consisting of a hydrogen atom, an alkyl group with 1 to 4 carbon atoms, a phenyl group substituted with an alkyl group with 1 to 4 carbon atoms or an alkoxy group with 1 to 4 carbon atoms, an unsubstituted phenyl group and an aralkyl group with 7 to 10 carbon atoms; $R^9$ represents one selected from the group consisting of a hydrogen atom, an alkyl group with 1 to 4 carbon atoms, an alkoxy group with 1 to 4 carbon atoms and a halogen atom.

Also in formulas (4) to (10), Ar represents a substituted or unsubstituted arylene group; X represents a characteristic group having a structure represented by general formula (3); m and s each represents 0 or 1; and t represents an integer from 1 to 3.

In formula (10), Ar is preferably represented by one of following formulas (11) and (12):

(11)

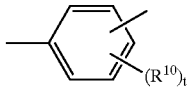

(12)

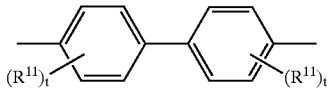

In formulas (11) and (12), $R^{10}$ and $R^{11}$ each has the same meaning as $R^9$; and t represents an integer from 1 to 3.

Also in formula (10), Z' is preferably a group represented by the following formula (13) or (14):

(13)

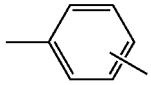

(14)

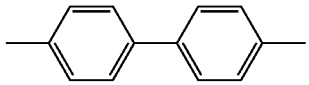

Also in formulas (4) to (10), X represents the characteristic group having a structure represented by general formula (3) as explained above, and $Y^1$ in such characteristic group can be a divalent hydrocarbon group represented by $—C_{\alpha}H_{2\alpha}—$, $—C_{\alpha'}H_{2\alpha'-2}—$ or $—C_{\alpha''}H_{2\alpha''-4}—$ ($\alpha$ being an integer from 1 to 15, $\alpha'$ being an integer from 2 to 15; and $\alpha''$ being an integer from 3 to 15), —N═CH—, —O—, —COO—, and also can be —S—, $—(CH)_{\beta}—$ ($\beta$ being an integer from 1 to 10), or a characteristic group represented by the foregoing general formula (11) or (12) or the following general formula (15) or (16).

(15)

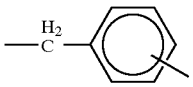

(16)

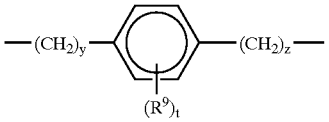

In formula (16), y and z each represents an integer from 1 to 5; t represents an integer from 1 to 3; and $R^9$ represents, as explained above, one selected from the group consisting of a hydrogen atom, an alkyl group with 1 to 4 carbon atoms, an alkoxy group with 1 to 4 carbon atoms and a halogen atom.

Also as explained in the foregoing, $Ar^5$ in formula (2) represents a substituted or unsubstituted aryl or arylene group, but, in the case of k=0, it preferably corresponds to any of structure group (I) shown below, and more preferably to any of structure group (II) shown below:

Structure Group (I)

In formula (2), in the case where k=0, $Ar^5$ is preferably a structure represented by the foregoing formula (4) with m=1, a structure represented by the foregoing formula (5) with m=1, a structure represented by the foregoing formula (6) with m=1, a structure represented by the foregoing formula (7) with m=1, or a structure represented by the foregoing formula (10) with m=1.

Structure Group (II)

In formula (2), in the case where k=1, $Ar^5$ is more preferably a structure represented by the foregoing formula (4) with m=1 and X is a methyl group, a structure represented by the foregoing formula (5) with m=1 and X is a methyl group, a structure represented by the foregoing formula (6) with m=1 and X is a methyl group, a structure represented by the foregoing formula (7) with m=1 and X is a methyl group, or a structure represented by the foregoing formula (10) with m=1 and X is a methyl group.

Also in the case where $Ar^5$ in formula (2) has a structure of any of the structure group (I) or any of the structure group (II), Z' in formula (10) is preferably one selected from the group consisting of those represented by following general formula (17) to (24).

$$—(CH_2)_q— \quad (17)$$

$$—(CH_2CH_2O)_r— \quad (18)$$

(19)

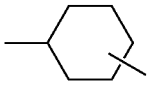

-continued (20)

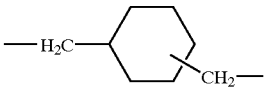

(21)

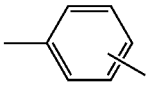

(22)

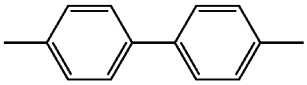

(23)

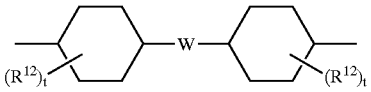

(24)

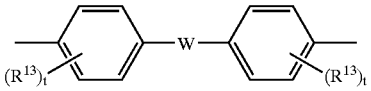

In formulas (17) to (24), $R^{12}$ and $R^{13}$ each represents one selected from the group consisting of a hydrogen atom, an alkyl group with 1 to 4 carbon atoms, an alkoxy group with 1 to 4 carbon atoms, and a halogen atom; W represents a divalent group; q and r each represents an integer from 1 to 10; and t represents an integer from 1 to 2.

In formulas (23) and (24), W is preferably any one of divalent groups represented by following formulas (25) to (33):

$$—CH_2— \quad (25)$$

$$—C(CH_3)_2— \quad (26)$$

$$—O— \quad (27)$$

$$—S— \quad (28)$$

$$—C(CF_3)_2— \quad (29)$$

$$—Si(CH_3)_2— \quad (30)$$

(31)

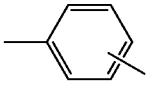

(32)

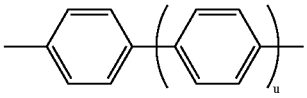

(33)

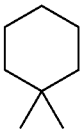

In formula (32), u represents an integer from 0 to 3.

Also specific examples of the compound represented by general formula (2) include compound numbers 1 to 274 shown in Tables 1 to 55 of JP-A No. 2001-83728.

The charge transport material represented by general formula (1) may be employed singly or in a combination of two or more thereof. Also, for further improving the mechanical strength of the cured film, the charge transport material represented by of general formula (1) may be used in combination with a compound represented by the following general formula (II):

$$B(—Si(OR^2)_aR^1_{3-a})_\gamma \quad (II)$$

In general formula (II), a, $R^1$ and $R^2$ have the same definitions as those in general formula (1); B represents an divalent organic group; and γ represents an integer equal to or larger than 2.

The compound represented by general formula (II) is a compound having the aforementioned substituted silicon group having a hydrolyzable group. The compound represented by general formula (II) forms, by a reaction of the —Si— group in the substituted silicon group with the substituted silicon group of the charge transport material represented by general formula (1) or of another neighboring compound represented by general formula (II), a three-dimensional —Si—O—Si— bond formed by crosslinking of an oxygen atom with neighboring —Si— groups. Thus, by a hydrolysis reaction between the substituted silicon groups in the compound represented by general formula (II) and the charge transport material represented by general formula (1), there is formed so-called inorganic glass-like network in the protective layer 2.

Also the charge transport material represented by general formula (1) can by itself form a protective layer 2 (cured film) having an inorganic glass-like network, but the compound represented by general formula (II), having two or more alkoxysilyl groups, is considered to more easily form a three-dimensional crosslinked structure in the cured film, thereby providing a higher mechanical strength. The compound represented by general formula (II) also serves, when employed as a component in the cured film, to provide the cured film with a suitable flexibility, like a portion $D^1$ of the charge transport material represented by general formula (1).

The compound represented by general formula (II) is preferably one represented by any of following general formulas (34) to (38). In general formulas (34) to (38), $T^1$ and $T^2$ each independently represents a bivalent or trivalent hydrocarbon group which may be branched; A represents the hydrolyzable substituted silicon group mentioned above; and h, i and j each independently represents an integer from 1 to 3. Also the compound represented by any of formulas (34) to (39) is selected so that the number of A within the molecule is equal to or larger than 2.

$$T^1[A]_j \quad (34)$$

(35)

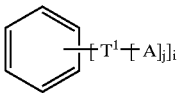

(36)

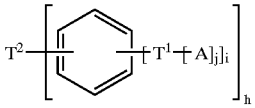

$$HN—[T^1—A]_2 \quad (37)$$

(38)

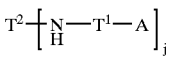

Preferred examples of the compound represented by general formula (II) are shown in Table 1, in which Me represents a methyl group; Et represents an ethyl group; and Pr represents a propyl group.

TABLE 1

| | |
|---|---|
| 1 | 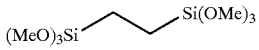 |
| 2 | 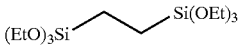 |
| 3 | 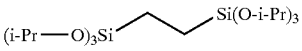 |
| 4 | 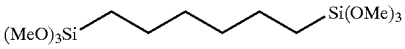 |
| 5 | 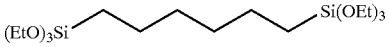 |
| 6 | 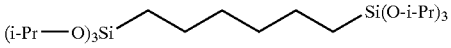 |
| 7 | 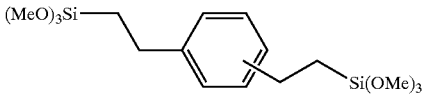 |
| 8 | 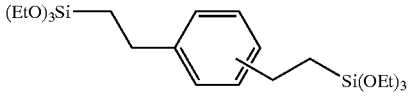 |
| 9 | 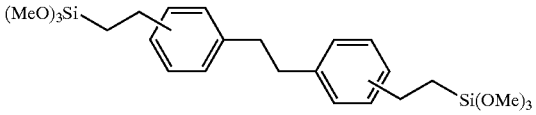 |
| 10 | 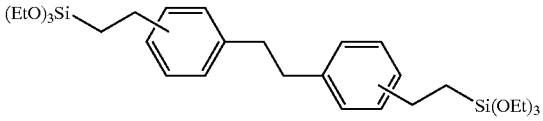 |
| 11 | 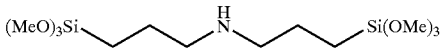 |
| 12 | 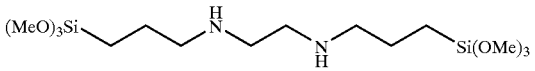 |
| 13 | $(MeO)_2MeSi(CH_2)_2SiMe(OMe)_2$ |
| 14 | $(EtO)_2EtSi(CH_2)_2SiEt(OEt)_2$ |
| 15 | $(MeO)_2MeSi(CH_2)_6SiMe(OMe)_2$ |
| 16 | $(EtO)_2EtSi(CH_2)_6SiEt(OEt)_2$ |
| 17 | $(MeO)_2MeSi(CH_2)_{10}SiMe(OMe)_2$ |
| 18 | $(EtO)_2EtSi(CH_2)_{10}SiEt(OEt)_2$ |
| 19 | $MeOMe_2Si(CH_2)_6SiMe_2OMe$ |

For forming the protective layer 2, in addition to the compound represented by general formula (II), there may be employed another compound capable of undergoing a crosslinking reaction. For such compound, there can be employed various silane coupling agents and commercially available silicone-based hard coat agents.

Examples of the silane coupling agent include vinyl trichlorosilane, vinyl trimethoxysilane, vinyl triethoxysilane, γ-glycidoxypropylmethyl diethoxysilane, γ-glycidoxypropyl trimethoxysilane, γ-aminopropyl triethoxysilane, γ-aminopropyl trimethoxysilane, γ-aminopropylmethyl dimethoxysilane, N-β-(aminoethyl)-γ-aminopropyl triethoxysilane, tetramethoxysilane, methyl trimethoxysilane and dimethyl dimethoxysilane.

Examples of the commercially available hard coating agent include KP-85, CR-39, X-12-2208, X-40-9740, X-41-1007, KNS-5300, X-40-2239 (foregoing manufactured by Shinetsu Silicone Ltd.), AY42-440, AY42-441, and AY49-208 (foregoing manufactured by Toray Dow-Corning Co.).

Also, for providing a surface lubricating property, there may be added a fluorine-containing compound to the protective layer 2 (cured surface layer). An increase in the surface lubricating property reduces a friction coefficient with the cleaning member, thereby improving the abrasion resistance. Also there is obtained an effect of preventing deposition of a discharge product, a developer and paper dusts to the surface of the photoreceptor, thereby extending the service life thereof.

As such fluorine-containing compound, there may be added a fluorine-containing polymer such as polytetrafluoroethylene or fine powder thereof. Also in the case of a protective layer 2 (cured film) formed by the compound of general formula (1), the fluorine-containing compound is preferably capable of reacting with alkoxysilane thereby forming a part of the crosslinked film. Examples of such fluorine-containing compound include (tridecafluoro-1,1,2,2-tetrahydrooctyl)triethoxysilane, (3,3,3-trifluoropropyl) trimethoxysilane, 3-(heptafluoroisopropoxy)propyl triethoxysilane, 1H,1H,2H,2H-perfluoroalkyl triethoxysilane, 1H,1H,2H,2H-perfluorodecyl triethoxysilane, and 1H,1H,2H,2H-perfluorooctyl triethoxysilane.

The addition amount of the silicon-containing compound is preferably 20% by weight or less. An exceeding amount may cause a difficulty in the film forming property of the crosslinked protective layer 2 (cured film).

Though the protective layer 2 (cured surface layer) has a sufficient oxidation resistance, an antioxidant may be added to provide higher oxidation resistance. As the antioxidant, preferred are hindered phenol compounds and hindered amine compounds, and there may be also employed a known antioxidant such as an organic sulfur antioxidant, a phosphite antioxidant, a dithiocarbamate antioxidant, a thiourea antioxidant or a benzimidazole antioxidant. The addition amount of the antioxidant is preferably 15% by weight or less, more preferably 10% by weight or less.

Examples of the hindered phenol antioxidant include 2,6-di-t-butyl-4-methylphenol, 2,5-di-t-butylhydroquinone, N,N'-hexamethylenebis(3,5-di-t-butyl-4-hydroxyhydrocinnamide), 3,5-di-t-butyl-4-hydroxy-benzyl-phosphonate diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butylphenol).

In the protective layer 2 (cured surface layer), there may be added other additives known for coated film formation, such as a leveling agent, an ultraviolet absorber, a light stabilizer, a surfactant etc.

Also in the protective layer 2, an alcohol-soluble resin may be added for the purposes of attaining a discharge gas resistance, a mechanical strength, a scratch resistance, a particle dispersibility, a viscosity control, a torque reduction, an abrasion control and a pot life extension. Examples of the resin soluble in alcoholic solvents include polyvinyl acetal resin such as polyvinyl butyral resin, polyvinyl formal resin or a partially acetalized polyvinyl acetal resin in which a part of butyral is denatured with formal or acetacetal (for example S-LEC B or K manufactured by Sekisui Chemicals Co.), polyamide resin, cellulose resin, and phenolic resin. Polyvinyl acetal resin is particularly preferred because of the electrical characteristics. The aforementioned resin preferably has an average molecular weight of 2,000 to 100,000, particularly preferably 5,000 to 50,000. An average molecular weight less than 2,000 is difficult to obtain desired effects, while an average molecular weight exceeding 100,000 reduces the solubility, thereby resulting in a limitation in the amount of addition, or a defective film formation at the coating. The addition amount of the resin is preferably 1 to 40% by weight, more preferably 1 to 30% by weight and most preferably 5 to 20% by weight. With an addition amount of the resin less than 1% by weight, it is difficult to obtain desired effects, while an amount exceeding 40% by weight tends to generate an image blur in an environment of a high temperature and a high humidity.

The protective layer 2 (cured surface layer) can be formed by coating a mixture of the above-described materials and various additives on the photosensitive layer and executing a heating treatment. Thus a three-dimensional crosslinking hardening reaction takes place to formed a firm cured film. The temperature of heating is not particularly limited as long as the underlying photosensitive layer is not affected, but is preferably within a range from the room temperature to 200° C., particularly from 100 to 160° C.

In the formation of the protective layer 2 (cured surface layer), the crosslinking hardening reaction may be carried out without a catalyst, but it is also possible to employ a suitable catalyst. Examples of the catalyst include an acid catalyst such as hydrochloric acid, sulfuric acid, formic acid, phosphoric acid, acetic acid or trifluoroacetic acid; a base catalyst such as ammonia or triethylamine; an organic tin compound such as dibutyl tin diacetate, dibutyl tin dioctoate or stannic octoate; an organic titanium compound such as tetra-n-butyl titanate or tetraisopropyl titanate; an iron salt, a manganese salt, a cobalt salt, a zinc salt or a zirconium salt of an organic carboxylic acid; and an aluminum chelate compound.

In forming the protective layer 2 (cured surface layer), in order to facilitate the coating, there may be added a solvent if necessary. There can be employed water or an ordinary organic solvent such as methanol, ethanol, n-propanol, isopropanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, dimethyl ether, or dibutyl ether, either singly or in a mixture of two or more thereof.

In forming the protective layer 2 (cured surface layer), there may be employed an ordinary coating method such as blade coating, Mayer bar coating, spray coating, dip coating, bead coating, air knife coating, or curtain coating.

The thickness of the protective layer 2 (cured surface layer) is not particularly restricted as long as it meets the requirement for the total thickness of the layers formed on the conductive substrate 3, but is preferably from 0.5 to 20 $\mu$m, particularly preferably 2 to 5 $\mu$m. It is also preferred that the total thickness of a photosensitive layer 7 to be explained later and the protective layer 2 is 25 $\mu$m or less.

In the case of forming the protective layer 2 not solely by the silicon-containing resin but by adding another substance in combination with the silicon-containing resin, a conductive substance included in a suitable binder resin may be added as such substance other than the silicon-containing resin. Examples of such conductive substance include a metallocene compound such as N,N'-dimethylferrocene, an aromatic amine compound such as N,N'-diphenyl-N,N'-bis(3-methylphenyl)-1,1'-biphenyl-4,4'-diamine, molybdenum oxide, tungsten oxide, antimony oxide, tin oxide, titanium oxide, indium oxide, a solid solution of tin oxide and antimony or antimony oxide, or a mixture thereof, or a particulate substance in which such metal oxide is mixed or which is coated with such metal oxide.

Also a binder resin may be included as a substance, other than the silicon-containing resin, to be included in the protective layer 2. Such binder resin can be, for example, polyamide resin, polyvinyl acetal resin, polyurethane resin, polyester resin, epoxy resin, polyketone resin, polycarbonate resin, polyvinyl ketone resin, polystyrene resin, polyacrylamide resin, polyimide resin or polyamidimide resin, which may be crosslinked if necessary.

The protective layer 2 can be formed in a similar manner as the photosensitive layer 7 or the like, employing a coating liquid in which the aforementioned conductive substance and the binder resin are mixed/dispersed in a predetermined solvent. The solvent to be employed in the coating liquid preferably has a dissolving power as low as possible for the binder resin of the underlying layer (charge transport layer 6 in the photosensitive layer 7 shown in FIG. 1).

The conductive substrate 3 is described below. The conductive substrate 3 is not particularly restricted as long as it has an electrical conductivity, and can be, for example, a metal drum such as of aluminum, copper, iron, stainless steel, zinc or nickel. There can also be employed an insulating material such as a polymer material (polyethylene terephthalate, polybutylene terephthalate, polypropylene, nylon, polystyrene, phenolic resin etc.) or a hard paper, which is rendered conductive by dispersing carbon black, indium oxide, tin oxide, antimony oxide, metal, copper iodide etc.); or the aforementioned insulting material laminated with a metal foil; or the aforementioned insulating material bearing an evaporated metal film thereon.

The shape of the conductive substrate 3 is not limited to cylindrical but can also be sheet-shaped or plate-shaped.

In the case where a metal pipe is employed as the conductive substrate 3, the surface of such substrate may be untreated, or may be subjected in advance to a treatment such as mirror surface grinding, etching, anodizing, rough cutting, centerless grinding, sand blasting, or wet honing. Roughing of the substrate surface by such surface treatment allows to prevent density speckles of a wood grain-like pattern that can be generated by an optical interference in the photoreceptor in the case of employing a coherent light source such as a laser beam.

The undercoat layer 4 is described below. The undercoat layer 4 includes conductive particles (metal oxide particles) and a binder resin. The volume resistance of such undercoat layer 4 is selected so as to be within a range of $10^8$ to $10^{13}$ Ω·cm (preferably $10^8$ to $10^{11}$ Ω·cm) under an application of an electric field of $10^6$ V/m in an environment of 28° C. and 85% RH, and also so as to meet the requirement that the volume resistance under an application of an electric field of $10^6$ V/m in an environment of 15° C. and 15% RH does not exceed 500 times of the volume resistance under an application of an electric field of $10^6$ V/m in an environment of 28° C. and 85% RH. Such control of the volume resistance of the undercoat layer 4 and the environmental dependence thereof so as to meet the aforementioned conditions allows to achieve the prevention of leak and the electrical characteristics simultaneously at a high level.

Also the undercoat layer 4 preferably meets the condition that the volume resistance under an application of an electric field of $10^6$ V/m in an environment of 28° C. and 85% RH does not exceed 1000 times of the volume resistance under an application of an electric field of $10^7$ V/m in an environment of 28° C. and 85% RH. A ratio of the volume resistance exceeding 1000 times tends to generate a leak in the case where the undercoat layer 4 is contaminated by a foreign substance, thereby being subjected to a locally strong electric field.

In the undercoat layer 4, it is possible to achieve control so that the volume resistance and the environmental dependence meet the aforementioned conditions, by suitably selecting kinds of the metal oxide particles and the binder resin, and the amounts thereof, and improving dispersion of the metal oxide particles in the binder resin.

Preferred specific examples of the metal oxide particles include tin oxide, titanium oxide, zinc oxide and aluminum oxide, and it is particularly preferred to select at least one selected from the group consisting of tin oxide, titanium oxide and zinc oxide. A powder resistance of such metal oxide particles is preferably within a range of $10^2$ to $10^{11}$ Ω·cm (preferably $10^4$ to $10^{10}$ Ω·cm). A powder resistance of the metal oxide particles lower than the lower limit tends to result in an insufficient leak prevention, while such resistance exceeding the upper limit tends to result in an increase in a residual potential in the electrophotographic process.

Also the metal oxide particles preferably have an average primary particle size of 100 nm or less, more preferably from 10 to 90 nm. An average primary particle size of the metal oxide particles exceeding 100 nm deteriorates the dispersibility in the binder resin, thereby rendering it difficult to attain the leak prevention and the electrical characteristics at the same time.

The metal oxide particles can be prepared by a known producing method. For example, zinc oxide can be obtained by an indirect method (French method) described in JIS K1410, a direct method (American method) or a wet method. Also titanium oxide can be obtained by a sulfuric acid method, a chlorine method, a fluoric acid method, a titanium potassium chloride method, or a titanium tetrachloride aqueous solution method. The metal oxide particles can also be obtained by an arc plasma method to be explained later.

In the indirect method, metallic zinc is heated (usually about 1000° C.) and zinc vapor is oxidized with hot air to obtain zinc oxide, which is classified, after cooling, by the particle size. In the direct method, zinc oxide, obtained by calcining a zinc ore is reduced for example with coal, and resulting zinc vapor is oxidized with hot air, or a slag obtained by treating a zinc ore with sulfuric acid is mixed with cokes, and such mixture is heated and resulting fused zinc is oxidized with hot air.

Also in the sulfuric acid method, titanium oxide particles are obtained through steps of preparation of a sulfate solution by a reaction or an ore and sulfuric acid, clearing of the solution, precipitation of titanium oxide hydrate by hydrolysis, rinsing, sintering, crushing and surface treatment. In the chlorine method, an ore is chlorinated to obtain a titanium tetrachloride solution, which is distilled and combusted and obtained titanium oxide is crushed and post-treated.

Examples of the arc plasma method includes a DC arc plasma method, a plasma jet method and an RF arc plasma method. For example in the DC arc plasma method, a metal raw material is used as a consumable anode, and a plasma flame is generated from a cathode to heat and evaporate the metal raw material, and resulting metal vapor is oxidized and cooled to obtain metal oxide particles. An arc discharge for generating the plasma flame is conducted in a gas of single-atom molecules such as argon or a gas of two-atom molecules such as hydrogen, nitrogen or oxygen, and a plasma generated by a thermal disassociation of the two-atom molecules is more reactive than a plasma derived from single-atom molecules (such as argon plasma) and is called a reactive arc plasma.

The metal oxide particles are preferably subjected to a coating treatment with at least a coupling agent, selected from the group consisting of a silane coupling agent (silicon-containing coupling agent), a fluorine-containing coupling agent, a titanate coupling agent (titanium-containing coupling agent), and an aluminate coupling agent (aluminum-containing coupling agent), and then to a heat treatment at 180° C. or higher. Use of the metal oxide particles subjected to such coating treatment with a coupling agent and a heat treatment allows to improve the dispersibility of the metal oxide particles in the binder resin, thereby enabling to easily and securely control the volume resistance and the environment dependence of the undercoat layer 4, thus achieving improvements in the leak prevention and in the electrical characteristics at the same time.

Examples of the silane coupling agent include vinyl trimethoxysilane, γ-methacryloxypropyl-tris(β-methoxyethoxy)silane, β-(3,4-epoxycyclohexyl)ethyl trimethoxysilane, γ-glycidoxypropyl trimethoxysilane, vinyl triacetoxysilane, γ-mercaptopropyl trimethoxysilane, γ-aminopropyl triethoxysilane, N-β-(aminoethyl)-γ-aminopropyl trimethoxysilane, N-β-(aminoethyl)-γ-aminopropylmethyl methoxysilane, N,N-bis(β-hydroxyethyl)-γ-aminopropyl triethoxysilane, and γ-chloropropyl trimethoxysilane. Also examples of the titanate coupling agent include isopropyl-triisostearoyl titanate, bis(dioctylpyrophosphate), isopropyltri(N-aminoethyl-aminoethyl)titanate etc., and examples of the aluminate coupling agent include acetalkoxyaluminum diisopropylate, and these may be employed singly or in a combination of two or more kinds.

Among these, preferred is a coupling agent having an amino group, such as γ-aminopropyl triethoxysilane, N-β-(aminoethyl)-γ-aminopropyl trimethoxysilane, N-β-(aminoethyl)-γ-aminopropylmethyl methoxysilane, N,N-bis(β-hydroxyethyl)-γ-aminopropyl triethoxysilane, isopropyltri(N-aminoethyl)titanate, because such coupling agent can efficiently and securely achieve a coating process. More preferred is a coupling agent having two amino groups such as N-β-(aminoethyl)-γ-aminopropyl trimethoxysilane, or N-β-(aminoethyl)-γ-aminopropylmethyl methoxysilane.

The coating process by such coupling agent can be carried out by dissolving the coupling agent in a solvent which does not substantially react with the coupling agent, and dispersing the metal oxide particles in such solution (processing liquid).

Examples of the solvent include toluene, ethylbenzene, tetrahydrofuran, ethyl acetate, butyl acetate, methylene chloride, chloroform, chlorobenzene, acetone, and methyl ethyl ketone, among which preferred is a high-boiling solvent such as toluene. In the preparation of the processing liquid, the coupling agent can be dispersed in the solvent by agitation, an ultrasonic treatment, a sand mill, an attritor, or a ball mill. The processing temperature can be arbitrarily selected within a range from the room temperature to the boiling temperature of the solvent.

The amount of the solvent to the metal oxide particles can be selected arbitrarily, but a weight ratio of the metal oxide particles to the solvent is preferably within a range from 1:1 to 1:10, more preferably from 1:2 to 1:4. In the case where the weight of the solvent is less than the weight of the metal oxide particles, a uniform processing becomes difficult to attain since the mixture becomes difficult to agitate and may cause gelation. On the other hand, in the case where the weight of the solvent is in excess of 10 times of the metal oxide particles, the coupling agent tends to remain unreacted. Also, the amount of the coupling agent is preferably 10% by weight or less with respect to the metal oxide particles in consideration of the electrical characteristics, the maintaining of the image quality and the film forming property, more preferably 0.1 to 5.0% by weight.

The coating process is carried out under agitation, but, in order to obtain a coating with the coupling agent more uniformly, there is preferably employed a dispersion medium such as silica gel, alumina or zirconia (preferably with a diameter of 0.5 to 50 mm).

Also in the case where the metal oxide particles show coagulation when the solvent is removed from the mixture after the coating process, it is preferred to crush the coagulated substance prior to the heat treatment. Also in order to promptly remove the solvent after the coating process, it is preferred to carry out distillation under a predetermined pressure (preferably 0.1 to 760 mmHg). Elimination of the solvent by filtration is possible, but is not preferred because the unreacted coupling agent tends to be eluted our and it is difficult to control the amount of the coupling agent required for obtaining desired characteristics.

The surface coating rate in the metal oxide particles after the coating process is preferably within a range of 7 to 20%. A surface coating rate less then the lower limit of the above-mentioned range cannot sufficiently elevate the resistance of the metal oxide particles, thereby decreasing the block property of the undercoat layer and deteriorating the image quality. On the other hand, a surface coating rate exceeding the upper limit tends to increase a residual potential of the electrophotographic photoreceptor in repeated use, and to increase an environmental fluctuation of the volume resistance. The surface covering rate mentioned above means a proportion [%] of the surface of the metal oxide particles covered by the coupling agent, and can be determined from a BET specific surface area of the metal oxide particles before the coating process and a composition amount of the coupling agent.

More specifically, a weight of the coupling agent required for obtaining a surface coating rate of 100% is given by the following formula:

(Weight [g] of the coupling agent required for obtaining a surface coating rate of 100%)={(weight [g] of metal oxide particles)×(BET specific surface area [$m^2$/g] of metal oxide)}/(minimum coating area [$m^2$/g] of coupling agent)

wherein the minimum coating area of the coupling agent means a minimum area that can be coated when 1 g of the coupling agent forms a monomolecular film. Also the surface coating rate can be determined from the following formula:

(Surface coating rate [%])=100×(weight [g] of coupling agent employed for coating process)/(weight [g] of coupling agent required for obtaining a surface coating rate of 100%).

The film coating formed by the reaction of the coupling agent can be made more complete by applying a heat treatment to the metal oxide particles subjected to the coating process. The temperature of the heat treatment is preferably 180° C. or higher as explained above, more preferably 200 to 300° C. and further preferably 200 to 250° C. A heat treatment temperature less than 180° C. cannot sufficiently eliminate remaining adsorbed water or coupling agent, thereby tending to result in insufficient electrical characteristics such as a dark delay. On the other hand, a heat treatment temperature exceeding 300° C. may cause a deposition of the film formed by the coupling agent or an oxidation of the surface of the metal oxide particles, thereby generating a charge trapping site and tending to elevate the residual potential. The period of the heat treatment is suitably selected according to the kind of the coupling agent and the heat treatment temperature, but is usually about 10 minutes to 100 hours.

Also the heat treatment of the metal oxide particles subjected to the coating process is preferably carried out by heating of two steps at different heat treatment temperatures. In such case, it is preferred that the heating of the first step is carried out at a temperature equal to or higher than the boiling temperature of the processing liquid, and the heating of the second step is carried out at 180° C. or higher (more preferably 200 to 300° C., further preferably 200 to 250° C.).

Examples of the binder resin for the undercoat layer 4 include a polymer resin compound such as an acetal resin such as polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenolic resin, a phenol-formaldehyde resin, and a melamine resin.

The undercoat layer 4 may be formed solely of the metal oxide particles and the binder resin mentioned in the foregoing, or may further contain an additive for improving the electrical characteristics, the environmental stability and the image quality, as long as the volume resistance and the environmental dependence satisfy the aforementioned conditions.

Examples of such additives include: electron transporting substances including a quinone compound such as chloranil, bromanil or anthraquinone, a tetracyanoquinodimethane compound, a fluorenone compound such as 2,4,7-trifluorofluorenone or 2,4,5,7-tetranitro-9-fluorenone, an oxadiazole compound such as 2-(4-biphenyl)-5-(4-t-butylphenyl)-1,3,4-oxadiazole, 2,5-bis(4-naphthyl)-1,3,4-oxadiazole, or 2,5-bis(4-diethylaminophenyl)-1,3,4-oxadiazole, a xanthone compound, a thiophene compound, and a diphenoquinone compound such as 3,3',5,5'-tetra-t-butyldiphenoquinone; electron transporting pigments including a condensed polycyclic compound or an azo compound; a silane coupling agent, a zirconium chelate compound, a titanium chelate compound, an aluminum chelate compound, a titanium alkoxide compound and an organic titanium compound.

Examples of the silane coupling agent include vinyl trimethoxysilane, γ-methacryloxypropyl-tris(β-methoxyethoxy)silane, β-(3,4-epoxycyclohexyl)ethyl trimethoxysilane, γ-glycidoxypropyl trimethoxysilane, vinyl triacetoxysilane, γ-mercaptopropyl trimethoxysilane, γ-aminopropyl triethoxysilane, N-β-(aminoethyl)-γ-aminopropyl trimethoxysilane, N-β-(aminoethyl)-γ-aminopropylmethyl methoxysilane, N,N-bis(β-hydroxyethyl)-γ-aminopropyl triethoxysilane, and γ-chloropropyl trimethoxysilane.

Examples of the zirconium chelate compound include zirconium butoxide, ethyl zirconium acetoacetate, zirconium triethanolamine, acetylacetonate zirconium butoxide, ethyl acetoacetonate zirconium butoxide, zirconium acetate, zirconium oxalate, zirconium lactate, zirconium phophonate, zirconium octanoate, zirconium naphthenoate, zirconium laurate, zirconium stearate, zirconium isostearate, methacrylate zirconium butoxide, stearate zirconium butoxide and isostearate zirconium butoxide.

Examples of the titanium chelate compound include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate and polyhydroxy titanium stearate.

Examples of the aluminum chelate compound include aluminum isopropylate, monobutoxy aluminum diisopropylate, aluminum butylate, diethylacetoacetate aluminum diisopropylate, and aluminum tris (ethylacetoacetate).

The undercoat layer 4 can be formed by mixing/dispersing for example the metal oxide particles and the binder resin in the predetermined solvent to prepare a coating liquid for the undercoat layer, and coating and drying such coating liquid for the undercoat layer 4 on the conductive substrate 3.

For mixing/dispersion in the preparation of the coating liquid, there can be utilized a method by a ball mill, a roll rill, a sand mill an attritor, or an ultrasonic treatment. Also for coating the coating liquid for forming the undercoat layer, there can be utilized blade coating, wire bar coating, spray coating, dip coating, bead coating, air knife coating or curtain coating. Also in the coating liquid, a small amount of silicone oil may be added as a leveling agent for improving the smoothness of the coated film.

The undercoat layer 4 thus obtained is adjusted to have a thickness of 20 to 40 μm. A thickness of the undercoat layer less than 20 μm cannot provide a sufficient leak preventing property. The leak preventing property is improved with an increase in the thickness of the undercoat layer, but a thickness exceeding 40 μm renders the film formation difficult and tends to result in a deterioration in the image quality resulting from an increase in the residual potential. Also the undercoat layer 4 preferably has a Vickers hardness of 35 or higher.

The surface roughness of the undercoat layer 4 is adjusted, for preventing Moire speckles, to a range from $1/4n\cdot\lambda$ (n being refractive index of an upper layer) to λ, wherein λ is the wavelength of the exposing laser to be employed. For the purpose of adjusting the surface roughness, it is possible to add resin particles in the undercoat layer. The resin particles can be particles of silicone resin or crosslinked PMMA resin. Also for adjusting the surface roughness, the undercoat layer may be ground. For grinding, there may be employed a buff grinding, a sand blasting, a wet honing or a cutting.

The photosensitive layer 7 is described below. As shown in FIG. 1, the photosensitive layer 7 can have a laminated structure comprising a charge generation layer 5 and a charge transport layer 6.

The charge generation layer 5 is constituted by containing a charge generating material and a binder resin. In addition to the aforementioned materials, there may also be contained a charge transport material, a solid lubricant, a metal oxide etc. to be explained below.

As the charge generating material there can be employed any known charge generating substance. For an infrared light, there is employed a phthalocyanine pigment, a squarilium, a bisazo, a trisazo, a perylene or ditioketopyrolopyrole, and, for a visible light, there is employed a condensed polycyclic pigment, a bisazo, a perylene, a trigonal selenium, or dye-sensitized metal oxide particles. Among these, a phthalocyanine pigment is employed as a preferred charge generating substance with an excellent performance. This material allows to obtain an electrophotographic photoreceptor of a particularly high sensitivity and an excellent stability in repeated use. The phthalocyanine pigment generally has several crystalline forms, but any crystalline form may be used as long as a sensitivity matching the purpose can be obtained. Examples of a particularly preferred charge generating substance include chlorogallium phthalocyanine, dichlorotin phthalocyanine, hydroxygallium phthalocyanine, metal-free phthalocyanine, titanyl phthalocyanine and chloroindium phthalocyanine.

The charge generating material to be preferably employed in the charge generation layer 5 can be prepared, for example, by a method of crushing pigment crystals, prepared in a known method, by dry crushing with an automatic mortar, a planetary mill, a vibration mill, a CF mill, a roller mill, a sand mill or a kneader, or by wet crushing with a ball mill, a mortar, a sand mill or a kneader together with a solvent after dry crushing.

A solvent to be employed in the aforementioned process can be, for example, an aromatic solvent (toluene, chlorobenzene etc.), an amide (dimethylformamide, N-methylpyrrolidone etc.), an aliphatic alcohol (methanol, ethanol, butanol etc.), an aliphatic polyhydric alcohol (ethylene glycol, glycerin, polyethylene glycol etc.), an aromatic alcohol (benzyl alcohol, phenetyl alcohol etc.), an ester (an acetate ester, butyl acetate etc.), a ketone (acetone, methyl ethyl ketone etc.), dimethyl sulfoxide, an ether (diethyl ether, tetrahydrofuran etc.), a mixed solvent of two or more of the foregoing solvents, or a mixed solvent of the foregoing solvent and water.

The use amount of the solvent is 1 to 200 parts by weight with respect to 1 part by weight of the pigment crystals, preferably 10 to 100 parts by weight. The process temperature in the wet crushing process is preferably from 0° C. to a boiling point of the solvent, more preferably 10 to 60° C. At the crushing, there may also be employed an auxiliary crushing agent such as sodium chloride or sodium sulfate. The auxiliary grinding agent can be employed in an amount of 0.5 to 20 times of the pigment, preferably 1 to 10 times (amount converted into weight).

Also the pigment crystals, prepared by a known method, may be controlled by an acid pasting or by a combination of an acid pasting and the aforementioned dry or wet crushing. The acid to be employed in the acid pasting is preferably sulfuric acid, having a concentration of 70 to 100%, preferably 95 to 100%. The amount of such concentrated sulfuric acid is selected within a range of 1 to 100 times of the weight of the pigment crystals, preferably 3 to 50 times (amount converted into weight). A dissolving temperature is selected within a range from −20 to 100° C., preferably 0 to 60° C. A solvent for precipitating the pigment crystals from the acid can be water or a mixed solvent of water and an organic solvent, and such solvent can be employed in an arbitrary amount. Also the temperature for precipitation is not particularly restricted, but it is preferred to carry out cooling with ice etc. in order to prevent heat generation.

The charge generating material can be subjected to a coating process with an organometallic compound having a hydrolyzable group or a silane coupling agent. Such coating process improves the dispersibility of the charge generating substance and the coating property of the coating liquid for forming the charge generation layer, thereby easily and securely obtaining a charge generation layer 5 which has a high smoothness and a high uniformity of dispersion. As a result, there can be prevented a defect in the image quality such as fogging or ghost, and the image quality can be maintained better. Also such process, significantly improving the storability of the coating liquid for the charge generation layer, is effective in extending the pot life and can further serve to reduce the cost of the photoreceptor.

The aforementioned organimetallic compound having the hydrolyzable group is represented by the following general formula (I):

$$R_p—M—Y_q \quad (I)$$

wherein R represents an organic group; M represents a metal atom other than an alkali metal or a silicon atom; Y represents a hydrolyzable group; p and q each represents an integer from 1 to 4; and a sum of p and q corresponds to an atomic valence of M.

In general formula (I), examples of the organic group represented by R include an alkyl group such as a methyl group, an ethyl group, a propyl group, a butyl group or an octyl group; an alkenyl group such as a vinyl group or an acryl group; a cycloalkyl group such as a cyclohexyl group; an aryl group such as a phenyl group, a tolyl group or a naphthyl group; an arylalkyl group such as a benzyl group or a phenylethyl group; an arylalkenyl group such as styryl group; and a heterocyclic residue such as a furyl group, a thienyl group, a pyrrolidinyl group, a pyridyl group or an imidazolyl group. Such organic group may have one or more substituents.

Also in general formula (I), examples of the hydrolyzable group represented by Y include an ether group such as a methoxy group, an ethoxy group, a propoxy group, a butoxy group, a cyclohexyloxy group, a phenoxy group, or benzyloxy group; an ester group such as an acetoxy group, a propionyloxy group, an acryloxy group, a methacryloxy group, a benzoyloxy group, a methane sulfonyloxy group, a benzene sulfonyloxy group or a benzyloxycarbonyl group; and a halogen atom such as a chlorine atom.

Also in general formula (I), M is not particularly restricted except for alkali metals, but is preferably a titanium atom, an aluminum atom, a zirconium atom or a silicon atom. Thus, in the photoreceptor of the invention, there is advantageously employed an organic titanium compound, an organic aluminum compound, or an organic zirconium compound substituted with an organic group or a hydrolyzable functional group, or a silane coupling agent.

Examples of the silane coupling agent include vinyl trimethoxysilane, γ-methacryloxypropyl-tris(β-methoxyethoxy)silane, β-(3,4-epoxycyclohexyl)ethyl trimethoxysilane, γ-glycidoxypropyl trimethoxysilane, vinyl triacetoxysilane, γ-mercaptopropyl trimethoxysilane, γ-aminopropyl triethoxysilane, N-β-(aminoethyl)-γ-aminopropylmethyl methoxysilane, N,N-bis(β-hydroxyethyl)-γ-aminopropyl triethoxysilane, γ-chloropropyl trimethoxysilane, vinyl triethoxysilane, vinyl tris(2-methoxyethoxysilane), 3-methacryloxypropyl trimethoxysilane, 3-glycidoxypropyl trimethoxysilane, 2-(3,4-epoxycyclohexyl)ethyl trimethoxysilane, N-2-(aminoethyl)-3-aminopropyl trimethoxysilane, N-2-(aminoethyl)-3-aminopropylmethyl dimethoxysilane, 3-aminopropyl triethoxysilane, N-phenyl-3-aminopropyl trimethoxysilane, 3-mercaptopropyl trimethoxysilane, and 3-chloropropyl trimethoxysilane.

Among these, more preferred are vinyl triethoxysilane, vinyl tris(2-methoxyethoxysilane), 3-methacryloxypropyl trimethoxysilane, 3-glycidoxypropyl trimethoxysilane, 2-(3,4-epoxycyclohexyl)ethyl trimethoxysilane, N-2-(aminoethyl)-3-aminopropyl trimethoxysilane, N-2-(aminoethyl)-3-aminopropylmethyl dimethoxysilane, 3-aminopropyl triethoxysilane, N-phenyl-3-aminopropyl trimethoxysilane, 3-mercaptopropyl trimethoxysilane, and 3-chloropropyl trimethoxysilane.

There can also be employed a hydrolysis product of the organometallic compound or silane coupling agent. The hydrolysis product can be a hydrolysis product of Y (hydrolyzable group) or a hydrolyzable substituent on R (organic group), bonded to M (metal atom other than alkali metal or silicon atom) in the organometallic compound represented by general formula (I). In the case where the organometallic compound or the silane coupling agent has plural hydrolyzable groups, it is not necessary to hydrolyze all the hydrolyzable groups and there may be employed a partially hydrolyzed product. Also the organimetallic compound and silane coupling agent may be employed singly or in a mixture of two or more thereof.

For effecting the coating process on the phthalocyanine pigment with the organometallic compound and/or the silane coupling agent having the hydrolyzable group (hereinafter collectively referred to as "organometallic compound"), there can be employed a method of coating the phthalocyanine pigment in the course of preparing crystals thereof, a method of coating the phthalocyanine pigment prior to the dispersion thereof in the binder resin, a method of mixing the organometallic compound at the dispersion of the phthalocyanine pigment in the binder resin, or a method of dispersing the organometallic compound after the dispersion of the phthalocyanine pigment.

More specifically, as a method of coating the phthalocyanine pigment in the course of preparing crystals thereof, there can be employed a method of mixing the organometallic compound and the phthalocyanine pigment before the preparation of the crystals thereof and then heating, a method of mixing the organometallic compound and the phthalocyanine pigment before the preparation of the crystals thereof and then executing a dry crushing, or a method of mixing a mixture of the organometallic compound with water or an organic solvent and the phthalocyanine pigment before the preparation of the crystals thereof and then executing a wet crushing.

Also, as a method of coating the phthalocyanine pigment prior to the dispersion thereof in the binder resin, there can be employed a method of mixing a mixture of the organometallic compound with water or with water and an organic solvent and the phthalocyanine pigment and executing heating, a method of directly spraying the organometallic compound to the phthalocyanine pigment, or a method of mixing and milling the organometallic compound and the phthalocyanine pigment.

Also as a method of mixing the organometallic compound at the dispersion of the phthalocyanine pigment in the binder resin, there can be employed a method of mixing, in a dispersion medium, the organometallic compound, the phthalocyanine pigment and the binder resin by addition in succession, or a method of simultaneously adding and mixing these components of the charge generation layer 5.

Also as a method of dispersing the organometallic compound after the dispersion of the phthalocyanine pigment, there can be employed a method of dispersing, under agitation, the organometallic compound diluted with a solvent, into a dispersion. Also in such dispersing process, in order to cause a more firm adhesion to the phthalocyanine pigment, there may be employed an acid catalyst such as sulfuric acid, hydrochloric acid or trifluoroacetic acid.

Among these, preferred is a method of coating the phthalocyanine pigment in the course of preparation of crystals thereof, or a method of coating the phthalocyanine pigment prior to the dispersion thereof in the binder resin.

The binder resin to be employed in the charge generation layer 5 can be selected from a wide range of binder resins. It can also be selected from organic photoconductive polymers such as poly-N-vinylcarbazole, polyvinylanthracene, polyvinylpyrene or polysilane. Preferred examples of the binder resin include insulating resins such as polyvinylacetal resin, polyarylate resin (polycondensate of bisphenol-A and phthalic acid etc.), polycarbonate resin, polyester resin, phenoxy resin, vinyl chloride-vinyl acetate copolymer, polyamide resin, acrylic resin, polyacrylamide resin, polyvinylpyridine resin, cellulose resin, urethane resin, epoxy resin, casein, polyvinylalcohol resin, and polyvinylpyrrolidone resin, among which particularly preferred is the polyvinylacetal resin. Such binder resins can be employed singly or in a mixture of two or more kinds. The composition ratio (weight ratio) of the charge generating substance and the binder resin in the charge generation layer 5 is preferably within a range from 10:1 to 1:10.

The charge generation layer 5 is formed by vacuum evaporation of a charge generating substance, or by coating of a coating liquid, including the charge generating substance and the binder resin. A solvent to be employed in the coating liquid is not particularly restricted as long as it can dissolve the binder resin, and can be arbitrarily selected for example from an alcohol, an aromatic compound, a halogenated hydrocarbon, a ketone, a ketone alcohol, an ether and an ester. Specific examples include methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene and toluene. These solvents may be used singly or as a mixture of two or more thereof.

For dispersing the charge generating substance and the binder resin in the solvent, there can be employed a dispersing method with a roll mill, a ball mill, a vibrating ball mill, an attritor, a sand mill, a colloid mill or a paint shaker. In such dispersion, it is effective to bring the average particle size of the charge generating substance to 0.5 $\mu$m or less, preferably 0.3 $\mu$m or less and more preferably 0.15 $\mu$m or less. Also in the coating liquid for the charge generation layer, additives explained in relation to the undercoat layer 4 may be added for the purpose of improving the electric characteristics and the image quality.

Also in coating such coating liquid, there can be employed blade coating, wire bar coating, spray coating, dip coating, bead coating, air knife coating, or curtain coating. Also in the coating liquid, a small amount of silicone oil may be added as a leveling agent for improving the smoothness of the coated film.

The film thickness of the charge generation layer 5 is not particularly restricted as long as the aforementioned range of the photosensitive layer 7 is satisfied, but is preferably within a range of 0.05 to 5 $\mu$m, more preferably 0.1 to 2.0 $\mu$m.

The charge transport layer 6 is described below. The charge transport layer 6 is constituted by including a charge transport material and a binder resin. Examples of such charge transport material include a positive hole transport substance for example an oxadiazole derivative such as 2,5-bis(p-diethylaminophenyl)-1,3,4-oxadiazole, a pyrazoline derivative such as 1,3,5-triphenylpyrazoline, or 1-[pyridyl-(2)]-3-(p-diethylaminostyryl)-5-(p-diethylaminostyryl)pyrazoline, an aromatic tertiary amino compound such as triphenylamine, tri(p-methylphenyl) amine, N,N'-bis(3,4-dimethylphenyl)biphenyl-4-amine, dibenzylaniline, or 9,9-dimethyl-N,N'-di(p-tolyl) fluorenone-2-amine, an aromatic tertiary diamino compound such as N,N'-diphenyl-N,N'-bis(3-methylphenyl)-[1,1-biphenyl]-4,4'-diamine, a 1,2,4-triazine derivative such as 3-(4,4'-dimethylaminophenyl)-5,6-di-(4'-methoxyphenyl)-

1,2,4-triazine, a hydrazone derivative such as 4-diethylaminobenzaldehyde-1,1-diphenylhydrazone, 4-diphenylaminobenzaldehyde-1,1-diphenylhydrazone, or [p-(diethylamino)phenyl]-(1-naphthyl)hydrazone, a quinazoline derivative such as 2-phenyl-4-styrylquinazoline, a benzofuran derivative such as 6-hydroxy-2,3-di(p-methoxyphenyl)-benzofuran, an α-stilbene derivative such as p-(2,2-diphenylvinyl)-N,N'-diphenylaniline, an enamine derivative, a carbazole derivative such as N-ethylcarbazole, poly-N-vinylcarbazole and a derivative thereof; and an electron transporting substance for example a quinone compound such as chloranilquinone, bromanilquinone, or anthraquinone, a tetracyanoquinodimethane compound, a fluorenone compound such as 2,4,7-trifluorofluorenone or 2,4,5,7-tetranitro-9-fluorenone, an oxadiazole compound such as 2-(4-biphenyl)-5-(4-t-butylphenyl)-1,3,4-oxadiazole, 2,5-bis(4-naphthyl)-1,3,4-oxadiazole, or 2,5-bis(4-diethylaminophenyl)-1,3,4-oxadiazole, a xanthone compound, a thiophene compound or a diphenoquinone compound such as 3,3',5,5'-tetra-t-butyldiphenoquinone; and a polymer having a residue obtained by eliminating a hydrogen atom from the foregoing compounds in a main chain or in a side chain. Such charge transport materials can be employed singly or in a combination of two or more thereof.

The binder resin of the charge transport layer 6 is not particularly limited, but preferred is a resin which is electrically insulating and is capable of forming a film. Examples of such a binder resin include polycarbonate resin, polyester resin, methacrylic resin, acrylic resin, polyvinyl chloride resin, polyvinylidene chloride resin, polystyrene resin, polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, silicone resin, silicone-alkyd resin, phenol-formaldehyde resin, styrene-alkyd resin, poly-N-carbazole, polyvinylbutyral, polyvinylformal, polysulfon, casein, gelatin, polyvinyl alcohol, ethyl cellulose, phenolic resin, polyamide, carboxymethyl cellulose, vinylidene chloride polymer wax, and polyurethane. Among these, polycarbonate resin, polyester resin, methacrylic resin, and acrylic resin are superior in a mutual solubility with the charge transport material, a solubility in the solvent and a strength, and can be advantageously employed. These binder resins can be employed singly or in a combination of two or more thereof.

The charge transport layer 6 can be formed with a coating liquid formed by mixing/dispersing the aforementioned charge transport material and the binder resin in a predetermined solvent. The solvent to be employed in the coating liquid can be those exemplified in the explanation of the coating liquid for the charge generation layer 5, but is preferably so selected as to have a low solubility to the binder resin of the charge generation layer 5. Also the composition ratio (weight ratio) of the charge transport material and the binder resin is preferably within a range from 3:7 to 6:4. In the case where the composition ratio is outside the aforementioned range, at least either of the electrical characteristics and the film strength tends to be deteriorated. Also, in the coating liquid, there may be added a small amount of silicone oil as a leveling agent for improving the smoothness of the coated film. Also for dispersion for preparing the coating liquid and for coating the coating liquid, there can be employed methods similar to those for the charge generation layer 5.

In the charge transport layer 6, a solid lubricant or a metal oxide may be dispersed for reducing the abrasion. As the solid lubricant, there is preferably dispersed at least one member selected from the group consisting of fluorine-containing resin particles (such as tetrafluoroethylene, trifluorochloroethylene, a tetrafluoroethylene-hexafluoropropylene resin, a fluorinated vinylic resin, a fluorinated vinylidene resin, difluorodichloroethylene or a copolymer thereof), metal oxides (such as silicon oxide, aluminum oxide, or titanium oxide), silicon-containing resin particles, and colloidal silica particles.

For such a purpose, there can be adopted a method of dispersing fluorine-containing resin particles or silicon-containing resin particles in the charge transport layer 6 thereby reducing the friction coefficient, or a method of dispersing a metal oxide (such as silica, alumina, titanium oxide, tin oxide etc.) thereby increasing the mechanical strength. Also since the fluorine-containing resin particles are difficult to disperse, the dispersibility can be improved by employing an auxiliary dispersant based on a fluorine-containing polymer.

Also in dispersing the fluorine-containing resin particles in the charge transport layer 6, it is preferred to contain a fluorinated graft polymer in an amount of 0.1 to 10% by weight with respect to the fluorine-containing polymer particles.

For dispersing the solid lubricant or the metal oxide, there can be employed a dispersing method with a roll mill, a ball mill, a vibrating ball mill, an attritor, a sand mill, a colloid mill, a paint shaker, a homogenizer or a high-pressure homogenizer. In such a dispersion, it is effective to bring the size of the dispersed particles to 1.0 μm or less, preferably 0.5 μm or less. Also in the coating liquid for the charge transport layer, additives explained in relation to the undercoat layer 4 may be added for the purpose of improving the electric characteristics and the image quality. Also for coating such coating liquid, there can be employed blade coating, wire bar coating, spray coating, dip coating, bead coating, air knife coating, or curtain coating. Also in the coating liquid, a small amount of silicone oil may be added as a leveling agent for improving the smoothness of the coated film.

In the electrophotographic photoreceptor 1 shown in FIG. 1, the charge generation layer 5 and the charge transport layer 6 are laminated in succession in this order on the conductive substrate 3, but these layers may also be provided in an inverted order. Also another layer may be provided between these layers.

In the electrophotographic photoreceptor 1, the film thickness of the photosensitive layer 7 (the sum of the thickness of the charge generation layer 5 and the thickness of the charge transport layer 6) is adjusted to a range from 10 to 45 μm. A thickness of the photosensitive layer less than the lower limit of the aforementioned range reduces a pinhole leak resistance, thereby tending to generate black spots on the image, while a thickness exceeding the upper limit tends to cause an image streak of fine lines on the printed image. Further, it is preferred that the sum of the thickness of the photosensitive layer and the protective layer is not greater than 25 μm.

Also in order to prevent a deterioration of the photoreceptor by ozone or an oxidative gas generated in the image forming apparatus or by light or heat, an additive such as an antioxidant, a light stabilizer or a heat stabilizer may be added to the photosensitive layer 7 or to the protective layer 2.

Examples of the antioxidant include a hindered phenol, a hindered amine, paraphenylene diamine, an arylalkane, hydroquinone, spirochroman, spiroindanone and derivatives thereof, an organic sulfur compound and an organic phosphor compound.

Specific examples of phenolic antioxidant include 2,6-di-t-butyl-4-methylphenol, stylenized phenol, n-octadecyl-3-(3',5'-di-t-butyl-4'-hydroxyphenyl)propionate, 2,2'-methylene-bis-(4-methyl-6-t-butylphenyl), 2-t-butyl-6-(3'-t-butyl-5'-methyl-2'-hydroxybenzyl)-4-methylphenyl acrylate, 4,4'-butylidene-bis(3-methyl-6-t-butylphenol), 4,4'-thio-bis(3-methyl-6-t-butylphenol), 1,3,5-tris(4-t-butyl-3-hydroxy-2,6-dimethylbenzyl)isocyanurate, tetraquis [methylene-3-(3',5'-di-t-butyl-4'-hydroxyphenyl) propionate]-methane, and 3,9-bis[2-[3-(3-t-butyl-4-hydroxy-5-methylphenyl)propionyloxy]-1,1-dimethyethyl]-2,4,8,10-tetraoxaspiro[5,5]undecane.

Examples of the hindered amine compound include bis (2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensate, poly[{6-(1,1,3,3-tetramethylbutyl)imino-1,3,5-triazine-2,4-diimyl}{(2,2,6,6-tetramethyl-4-piperidyl)imino}hexamethylene{(2,3,6,6-tetramethyl-4-piperidyl)imino}], 2-(3,5-di-t-butyl-4-hydroxybenzyl)-2-n-butyl malonate bis(1,2,2,6,6-pentamethyl-4-piperidyl), and N,N'-bis(3-aminopropyl) ethylenediamine-2,4-bis[N-butyl-N-(1,2,2,6,6-pentamethyl-4-piperidyl)amino]-6-chloro-1,3,5-triazine condensate.

Examples of the organic sulfur-containing antioxidant include dilauryl-3,3'-thiodipropionate, dimyristyl-3,3'-thiodipropionate, distearyl-3,3'-thiodipropionate, pentaerythritol-tetraquis(β-laurylthiopropionate), ditridecyl-3,3'-thiodipropionate, and 2-mercaptobenzimidazole.

Examples of the organic phosphor-containing antioxidant include trisnonylphenyl phosphite, triphenyl phosphite, and tris(2,4-di-t-butylphenyl)phosphite.

Among the antioxidants mentioned above, the organic sulfur-containing antioxidant or the organic phosphor-containing antioxidant is called a secondary antioxidant, and can obtain a multiplying effect by a combined use with a primary antioxidant such as a phenolic antioxidant or an amine antioxidant.

The light stabilizer includes derivatives of benzophenone, benzotriazole, dithiocarbamate or tetramethylpiperidine compounds.

Specific examples of the benzophenone light stabilizer include 2-hydroxy-4-methoxybenzophenone, 2-hydroxy-4-octoxybenzophenone, and 2,2'-dihydroxy-4-methoxybenzophenone.

Examples of the benzotriazole light stabilizer include 2-(2'-hydroxy-5'-methylphenyl)benzotriazole, 2-[2'-hydroxy-3'-(3",4",5",6"-tetrahydrophthalimidmethyl)-5'-methylphenyl]benzotriazole, 2-(2'-hydroxy-3'-t-butyl-5'-methylphenyl)-5-chlorobenzotriazole, 2-(2'-hydroxy-3'-t-butyl-5'-methylphenyl)-5-chlorobenzotriazole, 2-(2'-hydroxy-3',5'-di-t-butylphenyl)benzotriazole, 2-(2'-hydroxy-5'-t-octylphenyl)benzotriazole, and 2-(2'-hydroxy-3',5'-di-t-amylphenyl)benzotriazole. In addition, there may be employed 2,4-di-t-butylphenyl-3',5'-di-t-butyl-4'-hydroxybenzoate or nickel dibutyl-dithiocarbamate.

Also for the purposes of improving the sensitivity, reducing the residual potential and decreasing a fatigue in the repeated use, there may be included at least an electron accepting substance in the photosensitive layer 7 or in the protective layer 2. Examples of such electron accepting substance include succinic anhydride, maleic anhydride, dibromosuccinic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Among these, particularly preferred is a fluorenone compound, a quinone compound or a benzene derivative having an electron attracting substituent such as Cl, CN or $NO_2$.

In the photoreceptor 100, an oxide film layer (not shown) may be further provided between the conductive substrate 3 and the undercoat layer 4. The oxide film layer is not particularly limited as long as it is composed of a metal oxide, but, in consideration of the production efficiency, it is preferably an anodized film formed by anodizing the conductive substrate 3 (for example an aluminum substrate) in an acidic liquid containing an oxidant. The oxide film layer may also be formed by applying a boemite process to the conductive substrate 3.

In the case of employing an aluminum substrate as the conductive substrate 3, the aluminum substrate is preferably subjected to a degreasing-rinsing process prior to the anodizing process, in order to achieve an efficient anodizing process. The degreasing-rinsing process is not particularly limited as long as a sufficient rinsing effect can be obtained, and can be carried out by a known technology such as a process utilizing an acid, an alkali, an organic solvent or a surfactant, or a process utilizing an electrolysis.

The anodizing process can be carried out by immersing an aluminum substrate in an acidic liquid such as sulfuric acid, phosphoric acid, chromic acid, oxalic acid, boric acid or sulfamic acid. Sulfuric acid is most preferably employed as the acid to be employed.

In the case of anodizing process with sulfuric acid, there are preferably employed conditions of a sulfuric acid concentration of 20 to 300 g/L, a liquid temperature of 0 to 5° C., a dissolved aluminum concentration of 1 to 30 g/L, and an electrolytic voltage of 5 to 30 V. The obtained oxide film layer 2 preferably has a thickness of 0.1 to 20 μm, more preferably 1 to 15 μm.

The obtained oxide film layer may be subjected to a pore sealing process for improving the chemical stability of the film. The pore sealing process is not particularly restricted as long as desired characteristics of the photoreceptor (for example electrical characteristics, image quality characteristics etc.) can be realized on the oxide film layer after such process, but there is particularly preferably employed a method of immersing in an aqueous solution containing nickel fluoride, a method of immersing in an aqueous solution containing nickel acetate or a method immersing in boiling water.

Other examples of the electrophotographic photoreceptor to be mounted in the image forming apparatus of the present invention are described below. Such other examples of the electrophotographic photoreceptor have a configuration similar to that of the electrophotographic photoreceptor 1 shown in FIG. 1, except that the photosensitive layer has a single-layered (one layer) structure.

The single-layered photosensitive layer is formed by containing the aforementioned charge generating material, and a binder resin if necessary. The single-layered photosensitive layer may include, in addition to the materials mentioned above, a charge transport material, a solid lubricant, a metal oxide, etc. described in the foregoing. Also it can be prepared in a similar manner as the aforementioned electgrophotographic photoreceptor 1.

The film thickness of the photosensitive layer of single-layered structure is adjusted to a range from 30 to 45 μm. A thickness of the photosensitive layer less than the above-mentioned lower limit reduces a pinhole leak resistance, thereby tending to generate black spots on the image, while a thickness exceeding the upper limit tends to cause an image streak of fine lines on the printed image.

In the electrophotographic photoreceptor of the above-described single-layered structure, the total thickness of the layers formed on the conductive substrate 3 is adjusted to a range from 50 to 90 μm. A total film thickness less than the aforementioned lower limit reduces a pinhole leak resistance, thereby tending to generate black spots on the image, while a total film thickness exceeding the upper limit tends to cause an image streak of fine lines on the printed image and to deteriorate the film forming property at the film formation.

Also the electrophotographic photoreceptor having the photosensitive layer of the above-described single-layered structure may be further provided with a protective layer 2 and an oxide film layer, as in the electrophotographic photoreceptor 1 explained in the foregoing.

Image Forming Apparatus

Preferred embodiments of the image forming apparatus of the invention, in which the above-described electrophotographic photoreceptor is mounted, are described below.

An electrophotographic photoreceptor 12 is rendered rotatable in the direction A at a predetermined rotation speed by a driving device (not shown). A charger 14 for charging the external periphery of the electrophotographic photoreceptor 12 is provided substantially above the electrophotographic photoreceptor 12.

Also substantially above the charger 14, there is provided an exposure device (light beam scanning device) 16. Although the details will be explained later, the exposure device 16 modulates plural laser beams, emitted from a light source utilizing a surface emitting laser array, according to an image to be formed, and deflects the beams in a main scanning direction, thereby scanning the external periphery, charged by the charger 14, of the electrophotographic photoreceptor 12 in a direction parallel to an axis thereof.

At a side of the electrophotographic photoreceptor 12, there is provided a developing device 18. The developing device 18 is provided with a roller-shaped housing body, which is rendered rotatable. Inside the housing body, there are provided four containing units, in which developing devices 18Y, 18M, 18C, 18K are respectively provided. The developing devices 18Y, 18M, 18C, 18K are respectively provided with developing rollers 20 and respectively store toners of yellow (Y), magenta (M), cyan (C) and black (K) colors.

Also substantially below the electrophotographic photoreceptor 12, an endless intermediate transfer belt 24 is provided. The intermediate transfer belt 24 is supported about rollers 26, 28, 30 and is so positioned as to be in contact with the external periphery of the electrophotographic photoreceptor 12. The rollers 26 to 30 are rotated by a driving power of a motor (not shown), thereby rotating the intermediate transfer belt 24 in a direction indicated by the arrow B.

A transfer device 32 is positioned opposite to the electrophotographic photoreceptor 12, across the intermediate transfer belt 24. A toner image formed on the external periphery of the electrophotographic photoreceptor 12 is transferred, by the function of the transfer device 32, onto an image forming surface of the intermediate transfer belt 24.

Below the intermediate transfer belt 24, there is provided a tray 34, which contains a plurality of papers P as a recording material in a stacked state. At upper left, in FIG. 3, of the tray 34 there is provided a pick-up roller 36, and a roller pair 38 and a roller 40 are provided in succession at a downstream side of a pickup direction of the paper P by the pickup roller 36. An uppermost recording paper in the stack is picked up from the tray by the rotation of the pickup roller 36 and is transported by the roller pair 38 and the roller 40.

Also a transfer device 42 is positioned opposite to the roller 30, across the intermediate transfer belt 24. The paper P, transported by the roller pair 38 and the roller 40, is fed into a gap between the intermediate transfer belt 24 and the transfer device 42, wherein a toner image formed on the image forming surface of the intermediate transfer belt 24 is transferred by the transfer device 42. At a downstream side of the transfer device 42 in the transporting direction of the paper P, a fixing device 44 having a pair of fixing rollers is provided, and the paper P bearing the transferred toner image is subjected to a fixation thereof by fusion in the fixing device 44, then is discharged from a body of the image forming apparatus 100 and is placed on an unrepresented tray.

Also opposite to the developing device 18 and across the electrophotographic photoreceptor 12, there is provided a charge eliminating/cleaning device 22 having functions of charge elimination of the external periphery of the electrophotographic photoreceptor 12 and of elimination of unnecessary toner remaining on the external periphery. When the toner image formed on the external periphery of the electrophotographic photoreceptor 12 is transferred onto the intermediate transfer belt 24, an area which has borne the transferred toner image, in the external periphery of the electrophotographic photoreceptor 12, is cleaned by the charge eliminating/cleaning device 22.

Figure 2:
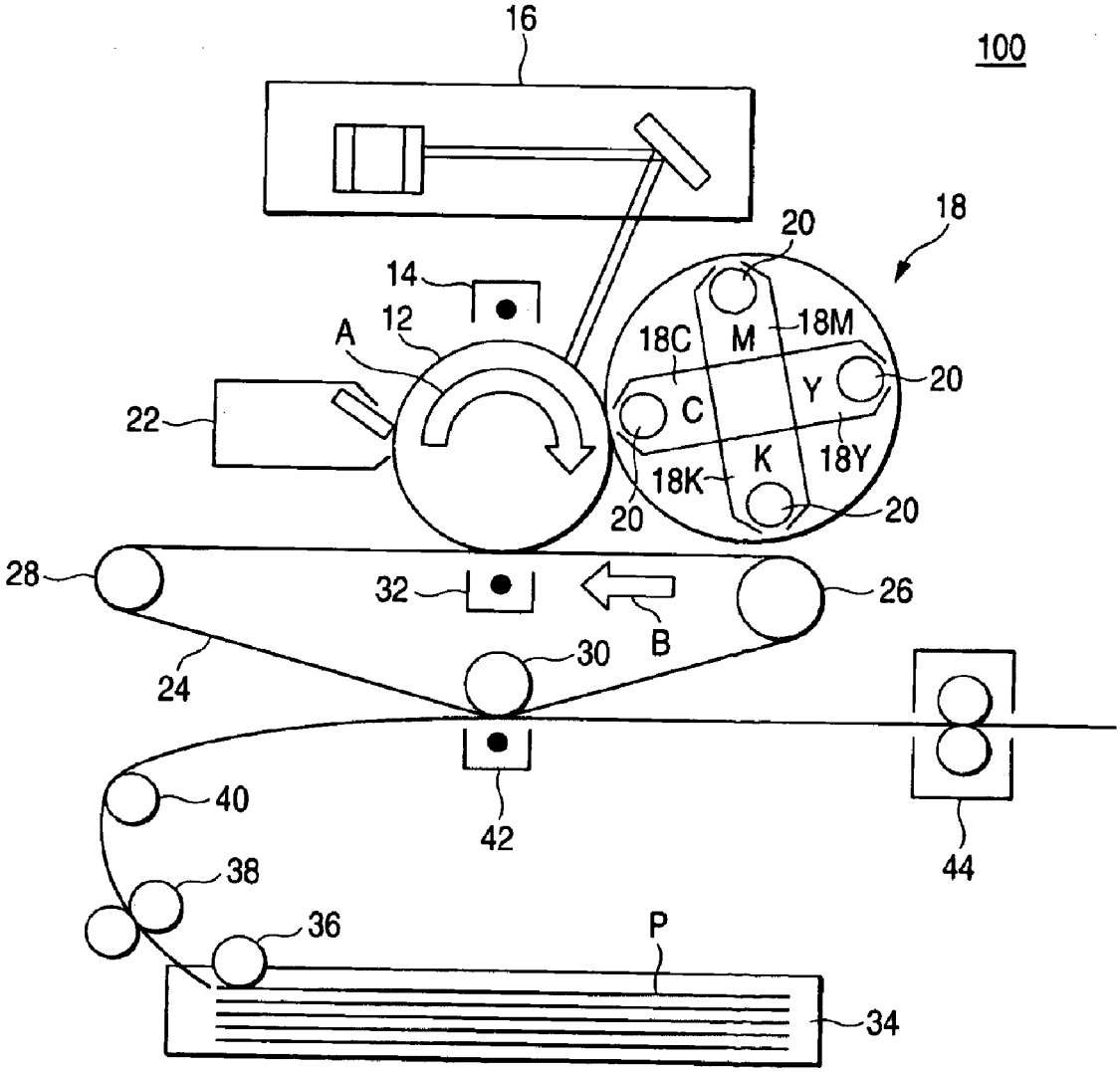
FIG. 2 is a schematic view showing a preferred embodiment of the image forming apparatus of the invention.

In the image forming apparatus 100 shown in FIG. 2, a full-color image is formed during a course of four turns of the electrophotographic photoreceptor 12. More specifically, in the course of 4 turns of the electrophotographic photoreceptor 12, the charger 14 continues the charging of the external periphery of the electrophotographic photoreceptor 12 while the charge eliminating/cleaning device 22 continues the charge elimination of the external periphery, and the exposure device 16 repeats scanning of the external periphery of the electrophotographic photoreceptor 12 with laser beams modulated according to one of Y, M, C, K image data representing an image to be formed, while switching the image data employed for modulating the laser beams for every turn of the electrophotographic photoreceptor 12. Also the developing device 18 repeats an activation, in a state in which the developing roller 20 of any of the developing devices 18Y, 18M, 18C, 18K is opposed to the external periphery of the electrophotographic photoreceptor 12, of the developing device positioned opposed to the external periphery thereby developing the electrostatic latent image, formed on the external periphery of the electrophotographic photoreceptor 12, in a specified color and forming a toner image of such specified color on the external periphery of the electrophotographic photoreceptor 12, while rotating the housing body so as to switch the developing device employed for developing the electrostatic latent image, at every turn of the electrophotographic photoreceptor 12.

Thus, in every turn of the electrophotographic photoreceptor 12, toner images of Y, M, C, K colors are formed in succession and in a mutually superposed state on the external periphery of the electrophotographic photoreceptor 12, and after 4 turns of the electrophotographic photoreceptor 12, a full-color toner image is formed on the external periphery of the electrophotographic photoreceptor 12.

As explained in the foregoing, the use of the exposure device 16 of multi beam type for scanning the electrophotographic photoreceptor with plural light beams for forming an electrostatic latent image in combination with the above-described electrophotographic photoreceptor 12 (same as the electrophotographic photoreceptor 1 shown in FIG. 1) allows, even in the case of employing the surface emitting laser array as the light source for the exposure device, to achieve an improvement in the image quality, a higher image forming speed and a dimensional reduction, and to obtain images of a satisfactory image quality even after repeating the image forming process over a prolonged period.

Figure 3:
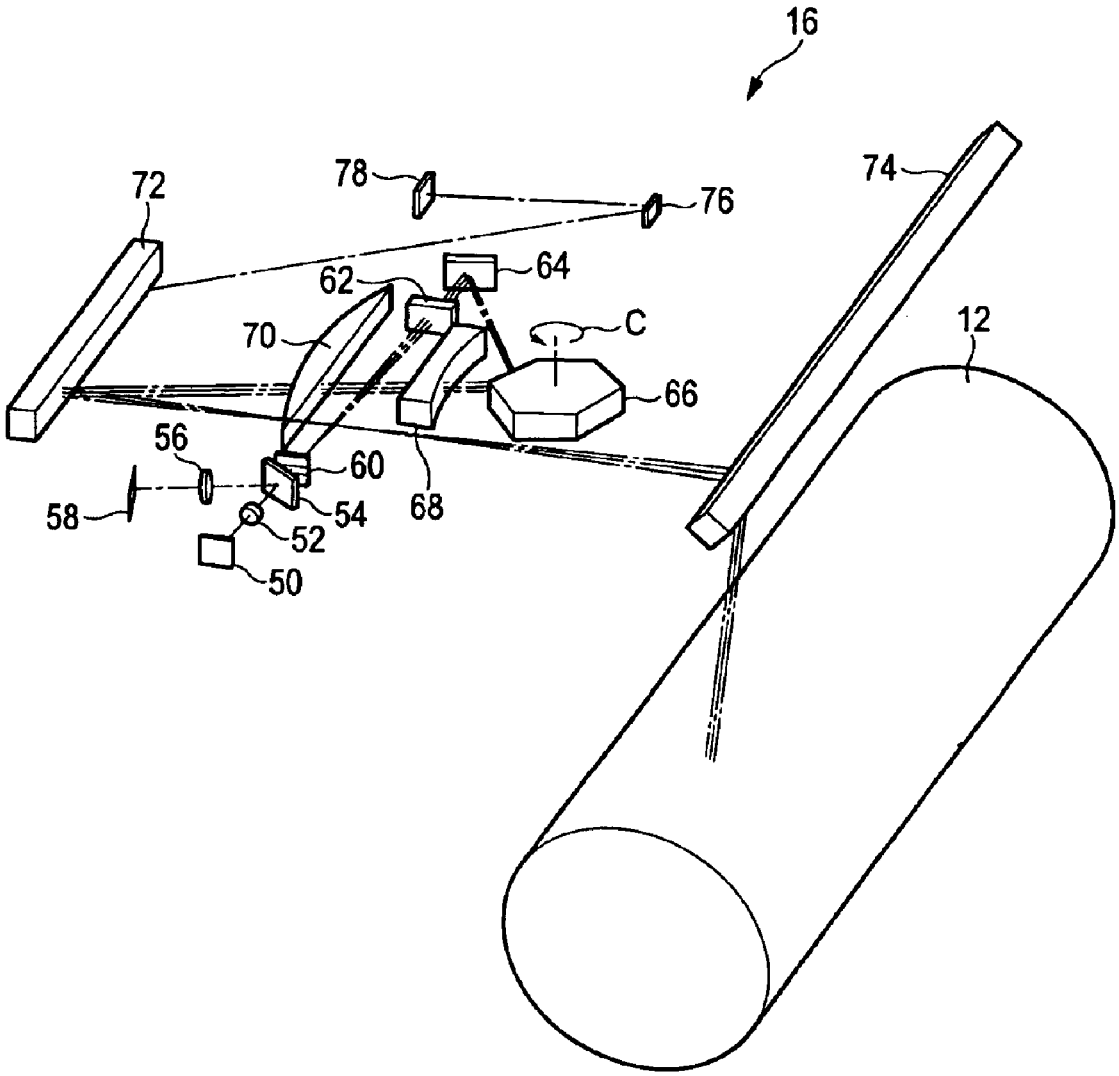
FIG. 3 is a schematic configurational view showing an example of the exposure device (optical scanning unit) of the invention.

In the following, reference is made to FIG. 3 for explaining the exposure device 16. The exposure device 16 is provided with a surface emitting laser array 50 which emits m laser beams (m being at least 3). FIG. 3 illustrates only 3 laser beams for the purpose of simplicity, but the surface emitting laser array 50, formed by an array of surface emitting lasers, can be so constructed as to emit for example several tens of laser beams, and the arrangement of the surface emitting lasers (arrangement of laser beams emitted from the surface emitting laser array 50) is not limited to a one-dimensional array but can also be a two-dimensional array (for example in a matrix arrangement).

Figure 4:
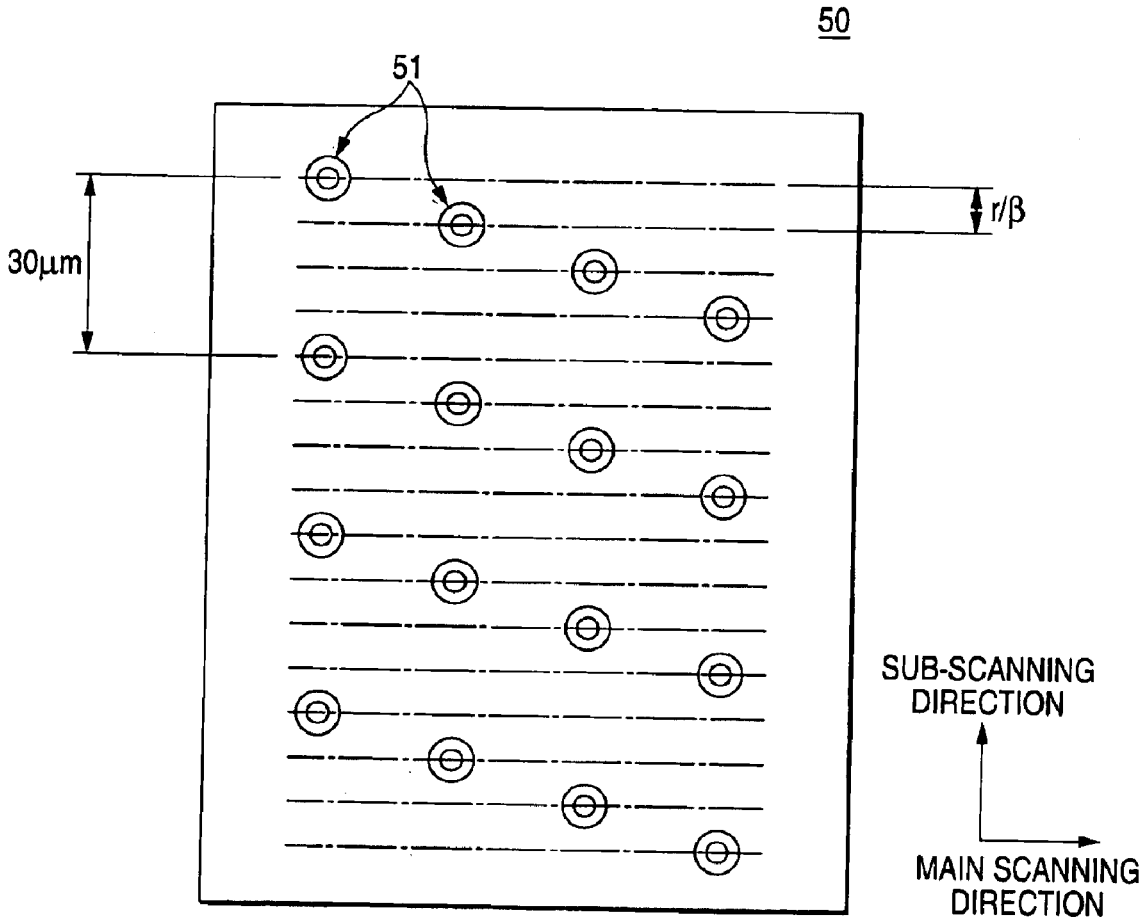
FIG. 4 is a plan view showing a laser array in which light emission points are arranged two-dimensionally.

FIG. 4 is a plan view showing a laser array 50 in which light emitting points 51 are arranged two-dimensionally. As illustrated, the laser array 50 has sixteen light emitting points 51, which are two-dimensionally arranged with 4 points in a main scanning direction and 4 points in a sub-scanning direction with a predetermined pitch. The light emitting points 51 in the main scanning direction are arranged with successive displacements of one step each, which is ¼ of a distance of the light emitting points adjacent in the sub-scanning direction. Thus, in the sub-scanning direction only, a light emitting point 51 is provided at each step. Thus, by arranging the light emitting points 51 with stepwise displacements in the sub-scanning direction, all the light emitting points 51 can scan the mutually different scanning lines. In this manner, the laser array 50 scans sixteen scan lines at the same time.

Again referring to FIG. 3, a collimating lens 52 and a half mirror 54 are arranged in succession at a laser beam exit side of the surface emitting laser array 50. A laser beam emitted from the surface emitting laser array 50 is formed into a substantially parallel light beam by the collimating lens 52, then enters the half mirror 54 and is partly separated and reflected by the half mirror 54. At a laser beam reflection side of the half mirror 54, a lens 56 and a light amount sensor 58 are provided in succession, and a partial laser beam, separated and reflected by the half mirror 54 from the main laser beam (laser beam used for exposure) enters the light amount sensor 58 through the lens 56, whereby the light amount is detected by the light amount sensor 58.

The surface emitting laser does not emit a laser beam from the side opposite to the side which emits the laser beam used for exposure (end face light emission laser emits light from both sides). Therefore, for detecting and controlling the light amount of the laser beam, it is necessary to separate a part of the laser beam used for the exposure, for the light amount detection.

In the main laser beam exit side of the half mirror 54, there are arranged in succession an aperture 60, a cylindrical lens 62 having a power only in the sub-scanning direction, and a fold-back mirror 64, whereby the main laser beam emitted from the half mirror 54 is shaped by the aperture 60, then refracted by the cylindrical lens 62 so as to be focused in a linear form elongated in the main scanning direction in the vicinity of a rotary polygon mirror 66, and is reflected by the fold-back mirror 64 toward the rotary polygon mirror 66. The aperture 60 is preferably positioned in the vicinity of a focal point of the collimating lens 52, in order to uniformly shape plural laser beams.

The rotary polygon mirror 66 is rotated in the direction C shown in FIG. 3 by a driving force of an unrepresented motor, and reflects and deflects the entering laser beam, reflected by the fold-back mirror 64, along the main scanning direction. At a laser beam exit side of the rotary polygon mirror 66, there are provided Fθ lenses 68, 70 having a power only in the main scanning direction, and the laser beam reflected and deflected by the rotary polygon mirror 66 moves at a substantially constant speed on the external periphery of the electrophotographic photoreceptor 12 and is so refracted by the Fθ lenses 68, 70 that the focal position in the main scanning direction coincides with the external periphery of the electrophotographic photoreceptor 12.

In the laser beam exit side of the Fθ lenses 68, 70, there are provided in succession cylindrical mirrors 72, 74 having a power only in the sub-scanning direction, and the laser beam transmitted by the Fθ lenses 68, 70 is reflected by the cylindrical mirrors 72, 74 in such a manner that the focal position in the sub-scanning direction coincides with the external periphery of the electrophotographic photoreceptor 12 and irradiates the external periphery of the electrophotographic photoreceptor 12. The cylindrical mirrors 72, 74 also have an image inclination correcting function which maintains the rotary polygon mirror 66 and the external periphery of the electrophotographic photoreceptor 12 in a conjugate relationship.

Also in the laser beam exit side of the cylindrical mirror 72, a pickup mirror 76 is provided in a position corresponding to a scan starting end (SOS: start of scan) in the scanning range of the laser beam, and, at a laser beam exit side of the pickup mirror 76, a beam position detecting sensor 78 is provided. The laser beam emitted from the surface emitting laser array 50 is reflected by the pickup mirror 76 and enters the beam position detecting sensor 78 when a laser beam reflecting face within the reflecting faces of the rotary polygon mirror 66 is so directed as to reflect the entering beam to a direction corresponding to SOS (see the imaginary line in FIG. 3).

A signal outputted from the beam position detecting sensor 78 is used for synchronizing a modulation start timing in each main scanning, in forming an electrostatic latent image by modulating the laser beam scanning on the external periphery of the electrophotographic photoreceptor 12 along with the rotation of the rotary polygon mirror 66.

Also in the exposure device 16 of the present embodiment, the collimating lens 52, the cylindrical lens 62 and the two cylindrical mirrors 72, 74 are positioned in an afocal relationship in the sub-scanning direction. Such arrangement is adopted in order to suppress a difference in a scanning line curvature (BOW) in plural laser beams and a fluctuation in the gap of the scanning lines formed by the plural laser beams.

Figure 5:
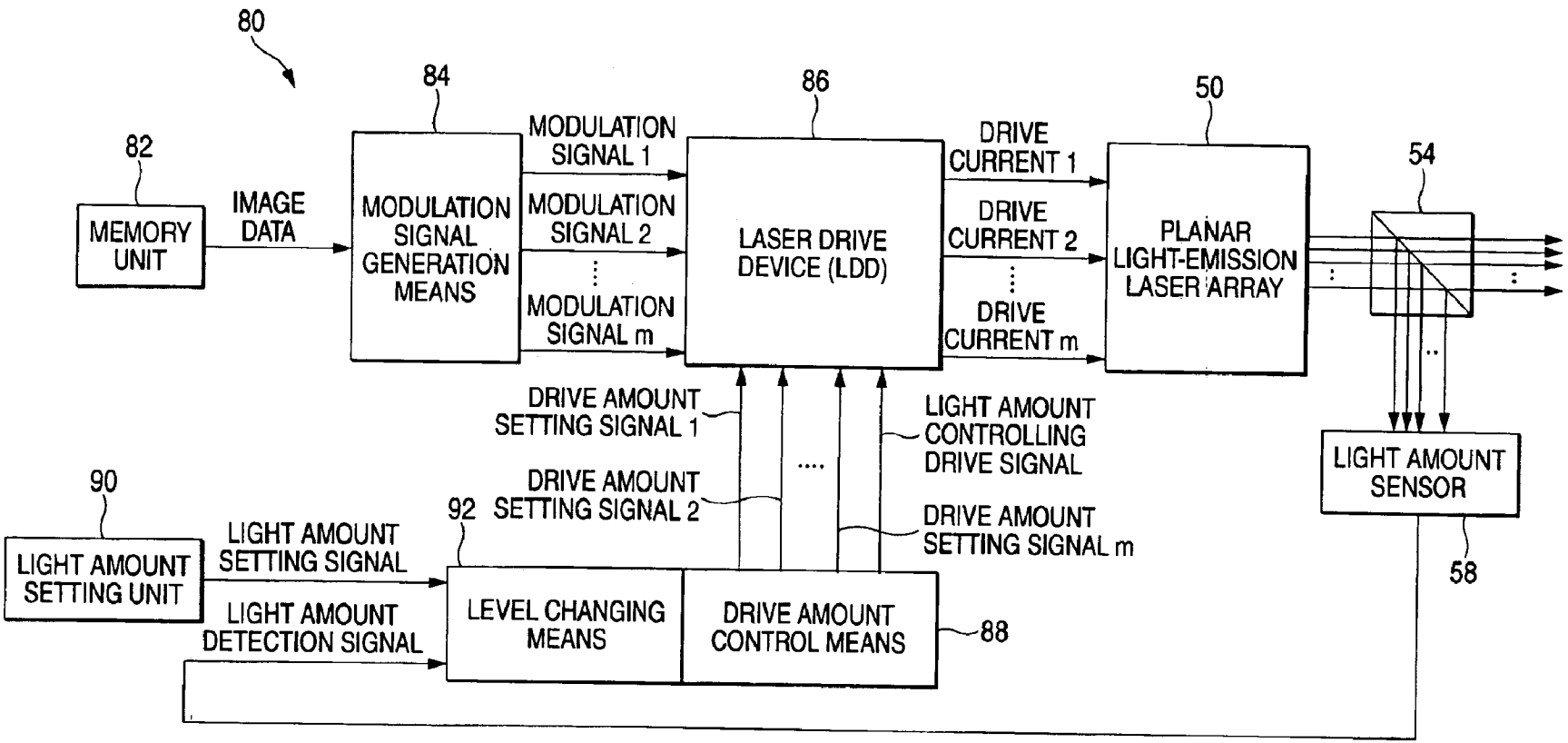
FIG. 5 is a schematic configurational view showing an example of a control apparatus of the invention.

With reference to FIG. 5, a configuration of the part for controlling emission of laser beams from the surface emitting laser array 50 in the exposure device 16 (such part being called a control unit 80) is described below. The control apparatus includes a memory unit 82 for storing image data representing an image to be formed by the image forming apparatus 100, and the image data stored in the memory unit 82 is entered into modulation signal generating means 84 of the control unit 80 at the image formation by the image forming apparatus 100.

Though not illustrated, the modulation signal generating means 84 is connected with the beam position detecting sensor 78. The modulation signal generating means 84 decomposes the image data, entered from the memory unit 82, into m image data respectively corresponding to m laser beams emitted from the surface emitting laser array 50, then generates, based on thus decomposed m image data, m modulation signals for defining the on-off timings for the m laser beams emitted from the surface emitting laser array 50, based on the SOS timing detected by the signal entered from the beam position detecting sensor 78, and outputs such signals to a laser drive device (LDD) 86.

The LDD 86, connected to drive amount control means 88 (to be explained later), turns on and off the m laser beams emitted from the surface emitting laser array 50 at timings corresponding to the modulation signals entered from the modulation signal generating means 84, and generates m drive signals for setting the light amounts of the laser beams, when turned on, at values corresponding to drive amount setting signals entered from the drive amount control means 88, and supplies such currents respectively to the m surface emitting lasers of the surface emitting laser array 50.

Thus the surface emitting laser array 50 emits m laser beams which are turned on and off at timings corresponding to the modulation signals and of which light amount in the on-state corresponds to the drive amount setting signals, and such m laser beams scan and expose the external periphery of the electrophotographic photoreceptor 12, thereby forming an electrostatic latent image thereon. Such electrostatic latent image is developed by the developing device 18 as a toner image, which is transferred onto a paper P through a transfer step by transfer devices 32, 42 and is fixed by fusion on the paper P in the fixing device 44, whereby an image is recorded on the paper P.

On the other hand, the image forming apparatus 100 is equipped with a density sensor (not shown) for detecting a density of either of a toner image formed on the external periphery of the electrophotographic photoreceptor 12, a toner image transferred onto the external periphery of the intermediate transfer belt 24 and an image recorded on the paper P, and such density sensor is connected to the control unit 80. In the case of forming an image (more exactly an electrostatic latent image) by scanning and exposing the external periphery of the electrophotographic photoreceptor 12 simultaneously with plural (m) laser beams as in the present embodiment, the irradiation (exposure) with the laser beam is carried out twice in the vicinity of a boundary of the scanning area by the m laser beams in each main scanning.

The present invention is not limited to the embodiment explained in the foregoing. For example, FIG. 2 shows a configuration employing a scorotron as the charging device, but there may also be employed a charging device of contact charging method utilizing a charging roller or a charging brush.

The developer to be employed in the image forming apparatus of the invention can be a one-component type or a two-component type, and can also be a normal developer or a reversal developer.

Also the image forming apparatus of the invention can be of an intermediate transfer type in which a toner image on an electrophotographic photoreceptor is transferred onto an intermediate transfer member and is then transferred to a transferred image-receiving medium.

Also the image forming apparatus of the invention can be, in addition to a configuration shown in FIG. 2, an image forming apparatus for a black-and-white image or a color image forming apparatus of a tandem type. The "tandem-type image forming apparatus" is an image forming apparatus having two or more image forming units as described below.

Figure 6:
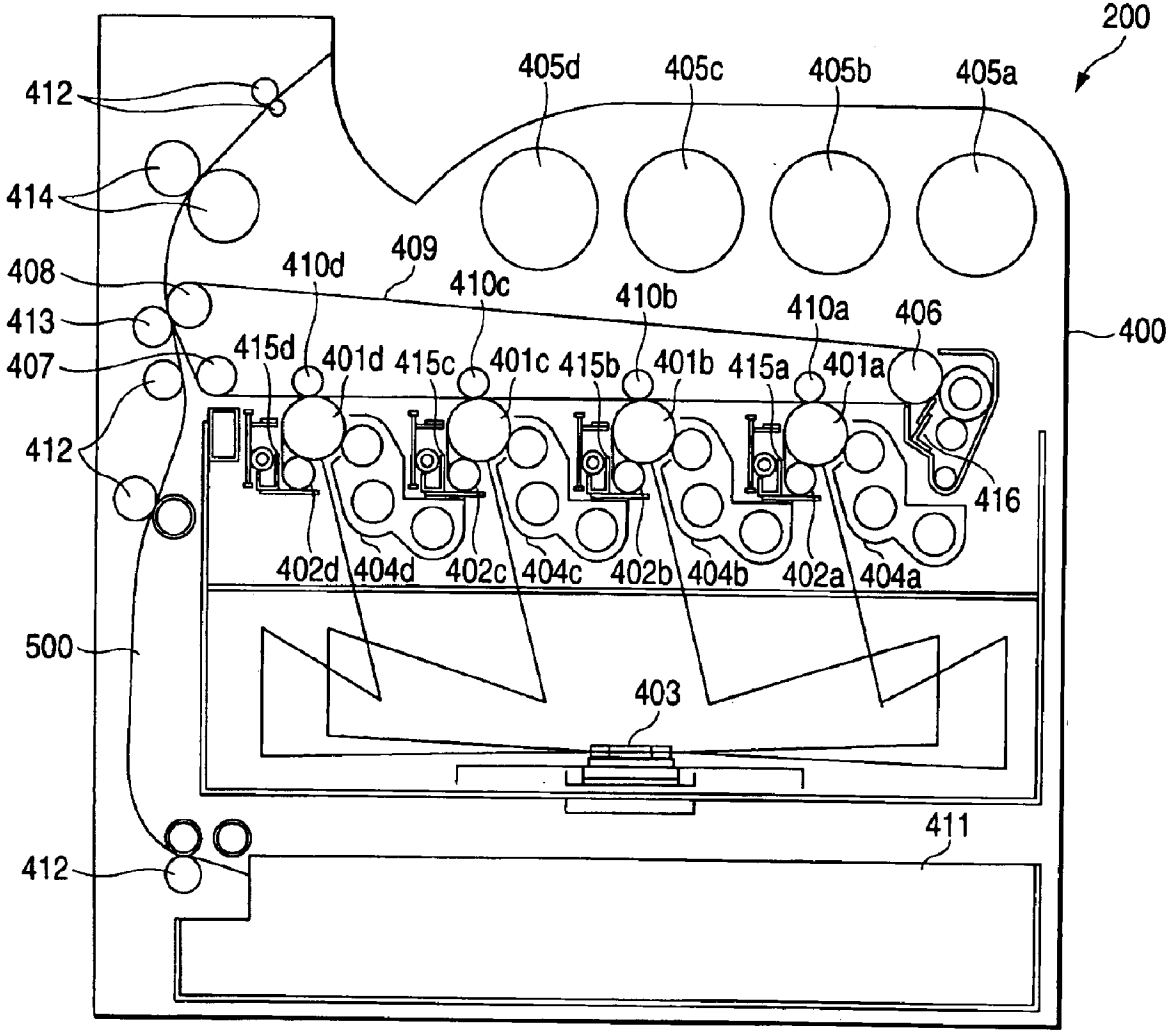
FIG. 6 is a cross-sectional view schematically showing a basic configuration of another preferred basic embodiment of the image forming apparatus of the invention.

FIG. 6 is a schematic cross-sectional view showing the configuration of a preferred embodiment of the image forming apparatus of the invention. An image forming apparatus 200 shown in FIG. 6 is a tandem-type image forming apparatus with two or more image forming units, having a configuration in which charging devices 402*a* to 402*d* are contact charging devices and a transfer device adopts an intermediate transfer method, and equipped at least with charging devices 402*a* to 402*d*, an exposure device 403 and developing device 404*a* to 404*d*.

More specifically, in the tandem-type image forming apparatus 200, four electrophotographic photoreceptors 401*a* to 401*d* (for example, the electrophotographic photoreceptors 401*a*, 401*b*, 401*c* and 401*d* being capable of respectively forming a yellow image, a magenta image, a cyan image and a black image) are provided in mutually parallel manner and along an intermediate transfer belt 409 in a housing 400. The image forming apparatus 200 is further provided with cleaning means 415*a* to 415*d*.

Each of the electrophotographic photoreceptors 401*a* to 401*d* mounted in the image forming apparatus 200 has the same configuration as that of the electrophotographic photoreceptor 1 shown in FIG. 1.

The electrophotographic photoreceptors 401*a* to 401*d* are rendered respectively rotatable in a predetermined direction (counterclockwise in the drawing), and, along the rotating direction, there are provided charging rollers 402*a* to 402*d* (contact charging devices for charging the electrophotographic photoreceptors), developing devices 404*a* to 404*d* (developing devices for developing electrostatic latent images formed by an exposure device thereby forming toner images), primary transfer rollers 410*a* to 410*d* (transfer devices for primary transfer of the toner images formed by the developing devices onto an intermediate transfer belt 409 (intermediate transfer member) described below) and cleaning blades 415*a* to 415*d* (cleaning means). The developing devices 404*a* to 404*d* can be supplied respectively with black, yellow, magenta and cyan toners contained in toner cartridges 405*a* to 405*d*. Also the primary transfer rollers 410*a* to 410*d* are respectively in contact with the electrophotographic photoreceptors 401*a* to 401*d* across an intermediate transfer belt 409 (intermediate transfer member for transferring a primary transferred image to a transferred image-receiving medium 500).

Also in a predetermined position in the housing 400, there is provided an exposure device 403 constituting a laser light source (exposure device for exposing the electrophotographic photoreceptor, charged by the charging device, thereby forming an electrostatic latent image), thereby enabling to irradiate the surfaces of the electrophotographic photoreceptors 401*a* to 401*d* after charging with laser beams emitted from the laser light source 403. The exposure device 403 has a configuration similar to that of the exposure device 16 explained in relation to FIGS. 2 to 5.

Thus, through rotations of the electrophotographic photoreceptors 401*a* to 401*d*, there are carried out in succession steps of charging, exposure, development, primary transfer and cleaning, whereby the toner images of respectively colors are transferred in superposition onto the intermediate transfer belt 409.

The charging devices (charging members) 402*a* to 402*d* are provided with roller-shaped contact charging members, which are so positioned as to be in contact with the surfaces of the photoreceptors 401*a* to 401*d*, and apply a uniform voltage to the photoreceptors thereby charging the surfaces thereof to a predetermined potential. For the charging device, there can be employed a metal such as aluminum, iron or copper; a conductive polymer such as polyacetylene, polypyrole, or polythiophene; or particles of carbon black, copper iodide, silver iodide, zinc sulfide, silicon carbide or a metal oxide dispersed in an elastomer material such polyurethane rubber, silicone rubber, epichlorohydrine rubber, ethylene-propylene rubber, acryl rubber, fluorinated rubber, styrene-butadiene rubber or butadiene rubber.

Examples of the metal oxide include ZnO, $SnO_2$, $TiO_2$, $In_2O_3$, $MoO_3$ and a complex oxide thereof. Also in the charging devices 402*a*–402*d*, there can be employed an elastomer material which is given an electrical conductivity by an addition of a perchlorate salt.

Further, the charging devices 402*a* to 402*d* may be provided with a covering layer on the surface thereof. A material constituting such covering layer can be, for example, N-alkoxymethylated nylon, a cellulose resin, a vinylpyridine resin, a phenolic resin, polyurethane, polyvinylbutyral, or a melamine resin, which can be used singly or in combination. Also there can be employed an emulsion resin, such as an acrylic resin emulsion, a polyester resin emulsion or an emulsion resin of polyurethane particularly synthesized by soap-free emulsion polymerization.

In such resin, it is possible to disperse particles of a conductive material for regulating the resistivity, or to include an antioxidant for preventing deterioration. Also it is possible to include a leveling agent or a surfactant in the emulsion resin, in order to improve a film forming property at the formation of the covering layer. Such contact charging member can have a roller shape, a blade shape, a belt shape or a brush shape.

The charging devices 402*a* to 402*d* has an electrical resistance preferably of $10^2$ to $10^{14}$ Ω·cm, more preferably $10^2$ to $10^{12}$ Ω·cm. A voltage applied to such contact charging member can be an AC voltage or a DC voltage. Also there can be applied an AC+DC voltage (a superposed voltage of AC and DC).

Also for the transfer devices 410*a* to 410*d* there can be employed a contact transfer charger utilizing a belt, a roller, a film or a rubber blade, or a scorotron transfer charger or a corotron transfer charger utilizing a corona discharge.

For the developing devices 404*a* to 404*d*, there can be employed an already known developing device utilizing a normal or reversal developer of one-component type or two-component type. Among these, for the reason of improving the image quality, there is preferred a two-component developing method utilizing a two-component developer. In such case, the developer employed for developing the electrostatic latent image is constituted of a toner and a carrier. The toner to be employed is not particularly limited in shape, and there can be advantageously employed an amorphous toner obtained by a crushing method or a spherical toner obtained by a polymerization method.

The cleaning means 415*a* to 415*d* serve to eliminate residual toner remaining on the surfaces of the electrophotographic photoreceptors 401*a* to 401*d* after the transfer step, and the thus cleaned electrophotographic photoreceptors 401*a* to 401*d* are used again in the aforementioned image forming process. As the cleaning means 415*a* to 415*d*, there can be employed a cleaning blade, a brush cleaning or a roller cleaning, among which preferred is a cleaning blade. A material constituting the cleaning blade can be urethane rubber, neoprene rubber or silicone rubber.

The intermediate transfer belt 409 can be produced in the following manner. At first, a tetracarboxylic acid dianhydride or a derivative thereof and a diamine in approximately equal molar amounts are polymerized in a predetermined solvent to obtain a polyamidacid solution. Such polyamidacid solution is supplied to and extended in a cylindrical mold to form a film (layer), which is then subjected to an imidation to obtain an intermediate transfer belt 409 of a polyimide resin.

Examples of such tetracarboxylic acid dianhydride include pyromeritic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, bis(3,4-dicarboxyphenyl)ether dianhydride and ethylenetetracarboxylic dianhydride.

Also examples of diamine include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenylsulfon, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenylsulfone, 4,4'-diaminodiphenylpropane, 2,4-bis(β-amino-t-butyl)toluene, bis(p-β-amino-t-butylphenyl)ether, bis(p-β-methyl-δ-aminophenyl)benzene, bis-p-(1,1-dimethyl-5-aminopentyl) benzene, 1-isopropyl-2,4-m-phenylenediamine, m-xylilenediamine, p-xylilenediamine, di(p-aminocyclohexyl)methane, hexamethylene diamine, heptamethylene diamine, octamethylene diamine, nonamethylene diamine, decamethylene diamine, diaminopropyl tetramethylene, 3-methylheptamethylene diamine, 4,4-dimethylheptamehylene diamine, 2,11-diaminododecane, 1,2-bis-3-aminopropoxyethane, 2,2-dimethylpropylene diamine, 3-methoxyhexamethylene diamine, 2,5-dimethylheptamethylene diamine, 3-methylheptamethylene diamine, 5-methylnonamethylene diamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_2)_2(CH_2)_3NH_2$.

As the solvent to be employed in polymerizing tetracarboxylic acid dianhydride and diamine, there is preferred a polar solvent in consideration of the solubility. As the polar solvent, there are preferred N,N-dialkylamides, among which particularly preferred are those of a low molecular weight such as N,N-dimethyl formamide, N,N-dimethyl acetamide, N,N-diethyl formamide, N,N-diethyl acetamide, N,N-dimethyl methoxyacetamide, dimetylsulfoxide, hexamethylphosphoryl triamide, N-methyl-2-pyrrolidone, pyridine, tetramethylene sulfone and dimethyl tetramethylene sulfone. These solvents may be employed singly or in a combination of two or more kinds.

Also for regulating a film resistance of the intermediate transfer belt 409, carbon may be dispersed in the polyimide resin. The kind of carbon is not particularly limited, but it is preferred to employ oxidized carbon black which is obtained by oxidizing carbon black to form an oxygen-containing functional group (such as carboxyl group, quinone group, lactone group or hydroxyl group) on the surface. The oxidized carbon black, dispersed in polyimide resin, passes an excessive current under a voltage application, whereby the polyimide resin is relieved from oxidation under repeated voltage applications. Also oxidized carbon black, showing a high dispersibility in the polymide resin because of the surfacially formed oxygen-containing functional group, can reduce a fluctuation in the resistance and a dependence on the electric field, whereby a concentration of the electric field under the transfer voltage becomes less likely to occur. It is therefore possible to obtain an intermediate transfer belt capable of preventing a loss in the resistance by the transfer voltage, improving uniformity of the electrical resistance, showing a reduced dependence on the electric field, also showing a smaller variation of the resistance under a change in the environmental conditions and providing high image quality with reduced image defects such as a white blank in a paper running portion.

The oxidized carbon black can be obtained, for example, by an air oxidation method of contacting carbon black with air in a high temperature environment, a method of reacting carbon black with nitrogen oxide or ozone at a normal temperature, or a method of executing oxidation with air at a high temperature followed by oxidation with ozone at a low temperature.

Examples of oxidized carbon black include commercially available ones for example products of Mitsubishi Chemical Corp. such as MA100 (pH 3.5, volatile content 1.5%), MA100R (pH 3.5, volatile content 1.5%), MA100S (pH 3.5, volatile content 1.5%), #970 (pH 3.5, volatile content 2.0%), MA11 (pH 3.5, volatile content 2.0%), #1000 (pH 3.5, volatile content 3.0%), #2200 (pH 3.5, volatile content 3.5%), MA230 (pH 3.0, volatile content 1.5%), MA220 (pH 3.0, volatile content 1.0%), #2650 (pH 3.0, volatile content 3.0%), MA7 (pH 3.0, volatile content 3.0%), MA8 (pH 3.0, volatile content 3.0%), OIL7B (pH 3.0, volatile content 6.0%), MA77 (pH 2.5, volatile content 3.0%), #2350 (pH 2.5, volatile content 7.5%), #2700 (pH 2.5, volatile content 10.0%), and #2400 (pH 2.5, volatile content 9.0%); products of Degussa Corp. such as Printex 150T (pH 4.5, volatile content 10.0%), Special Black 350 (pH 3.5, volatile content 2.2%), Special Black 100 (pH 3.3, volatile content 2.2%), Special Black 250 (pH 3.1, volatile content 2.0%), Special Black 5 (pH 3.0, volatile content 15.0%), Special Black 4 (pH 3.0, volatile content 14.0%), Special Black 4A (pH 3.0, volatile content 14.0%), Special Black 550 (pH 2.8, volatile content 2.5%), Special Black 6 (pH 2.5, volatile content 18.0%), Color Black W200 (pH 2.5, volatile content 20.0%), Color Black FW2 (pH 2.5, volatile content 16.5%), and Color Black FW2V (pH 2.5, volatile content 16.5%); and products of Cabott Inc. such as MONARCH 1000 (pH 2.5, volatile content 9.5%), MONARCH 1300 (pH 2.5, volatile content 9.0%), and MOGUL-L (pH 2.5, volatile content 5.0%), REGAL 400R (pH 4.0, volatile content 3.5%). Such oxidized carbon black preferably has a pH value of 4.5 or less and a volatile content of 1.0% or higher.

Such oxidized carbon, showing different electrical conductivity because of differences in physical properties for example in a level of oxidation, a DBP oil absorption amount, a specific surface area measured by a BET method utilizing nitrogen adsorption, may be employed singly or in a combination of two or more kinds, but it is preferred to employ two or more kinds with substantially different conductivities in combination. In the case of adding two or more carbon blacks with such different physical properties, it is possible to at first add carbon black showing for example a higher conductivity, and then to add carbon black of a lower conductivity thereby regulating the surface resistivity.

The content of such oxidized carbon black is preferably 10 to 50% by weight with respect to polyimide resin, more preferably 12 to 30% by weight. A content less than 10% by weight may reduce uniformity of the electrical resistance, thereby resulting in a large loss of the surface resistivity in a prolonged use, while a content exceeding 50% by weight is undesirable since a desired resistance becomes difficult to obtain and a molded substance becomes brittle.

The polyamidacid solution in which two or more oxidized carbon blacks are dispersed can be prepared, for example, by a method of dissolving and polymerizing the acid dianhydride component and the diamine component in a dispersion prepared in advance by dispersing two or more oxidized carbon blacks in a solvent, or a method of dispersing two or more oxidized carbon blacks respectively in solvents to obtain two or more carbon black dispersion liquids, then dissolving and polymerizing the acid anhydride component and the diamine component in these dispersion liquids, and mixing these polyamidacid solutions.

The intermediate transfer belt 409 can be obtained by supplying and extending thus prepared polyamidacid solution on an internal surface of a cylindrical metal mold to obtain a film, followed by heating to imidize the polyamidacid. At such imidation, a predetermined temperature is maintained for 0.5 hours or longer to obtain an intermediate transfer belt of a satisfactory flatness.

For supplying the polyamidacid solution to the internal surface of the cylindrical metal mold, there can be employed a method of utilizing a dispenser, or a method of utilizing a die. The cylindrical metal mold preferably has a mirror finished internal surface.

For forming a film from the polyamidacid solution supplied to the metal mold, there can be employed a method of centrifugal molding under heating, a molding method utilizing a bullet-like flying member, or a method of rotational molding, through which a film can be obtained with a uniform thickness.

For imidizing thus formed film thereby obtaining an intermediate transfer belt, there can be employed (i) a method of placing the metal mold, containing the film, in a dryer and heating to an imidizing reaction temperature, or (ii) a method of eliminating the solvent until a shape of a belt can be retained, then peeling the film from the internal surface of the metal mold and replacing the film on an external surface of a metal cylinder, and heating the film with the metal cylinder to achieve imidation. In the invention, the imidation may be achieved by either of the methods (i) and (ii) as long as the obtained intermediate transfer belt has a dynamic surface hardness satisfying the aforementioned condition, but the imidation by the method (ii) is preferred since it can efficiently and securely provide an intermediate transfer belt of a flatness and a precision of the external surface in a satisfactory level. In the following there will be given a detailed explanation on the method (ii).

In the method (ii), a heating condition for eliminating the solvent is not particularly limited, but there are preferred a heating temperature of 80 to 200° C. and a heating period of 0.5 to 5 hours. The molded material, becoming capable of retaining a shape of a belt, is peeled from the internal surface of the metal mold, and, for such peeling, a releasing treatment may be applied to the internal periphery of the metal mold.

Then, the molded material which has been heated and cured so as to retain a shape of a belt is replaced on an external surface of a metal cylinder and is heated together with such cylinder, whereby imidizing reaction of polyamidacid is promoted. Such metal cylinder preferably has a linear expansion coefficient larger than that of polyimide resin, and has an external diameter smaller by a predetermined amount than the internal diameter of the molded polyimide material, thereby enabling to achieve heat setting and to obtain an endless belt with a uniform thickness. Also the metal cylinder has a surface roughness (Ra) of the external surface preferably within a range of 1.2 to 2.0 μm. A surface roughness (Ra) of the external surface of the metal cylinder less than 1.2 μm, namely an excessively high smoothness of the metal cylinder itself, does not allow the obtained intermediate transfer belt to slide in the axial direction of the belt upon shrinkage whereby a drawing is carried out in this stage to result in a fluctuation in the film thickness and to deteriorate the precision of the flatness. Also a surface roughness (Ra) of the external surface of the metal cylinder exceeding 2.0 μm causes a transcription of the shape of the external surface of the metal cylinder onto the internal surface of the intermediate transfer belt and generates irregularities on the external surface thereof, thereby leading to an image defect. The surface roughness Ra described in the present specification is measured according to JIS B601.

Heating conditions at the imidation, though dependent on the composition of the polyimide resin, preferably include a heating temperature of 220 to 280° C. and a heating time of 0.5 to 2 hours. The imidation under such heating conditions provides a larger shrinkage of the polyimide resin, thus inducing a low shrinkage in the axial direction of the belt and preventing a fluctuation in the film thickness and a deterioration in the precision of the flatness.

The intermediate transfer belt of thus obtained polyimide resin preferably has a surface roughness (Ra) of the external surface of 1.5 μm or less. A surface roughness (Ra) of the intermediate transfer member exceeding 1.5 μm tends to result in an image defect such as a roughened image. The present inventors estimate that an electric field induced by a voltage applied at the transcription or by a peeling discharge is concentrated locally in projecting portions on the belt surface to denature the surface of such projecting portions, whereby new conductive paths are developed to reduce the electrical resistance, thereby resulting in a lower image density and leading to a roughened image.

The intermediate transfer belt 409 thus obtained is preferably a seamless belt. In the case of such seamless belt, the thickness of the intermediate transfer belt 409 can be suitably selected according to the purpose of use, but is preferably 20 to 500 μm, more preferably 50 to 200 μm in consideration of mechanical characteristics such as a strength and a flexibility. Also, concerning the surface resistance, the intermediate transfer belt 409 preferably has a common logarithmic value of a surface resistivity (Ω/square) within a range of 8 to 15 (logΩ/square) and more preferably 11 to 13 (logΩ/square). The surface resistivity used herein means a value obtained by applying a voltage of 100 V in an environment of 22° C. and 55% RH, and measuring a current at 10 seconds after the start of voltage application. The "surface resistance (Ω/square)" has the same meaning as "surface resistance" described in "Thin Film Handbook (Ohm-sha)", p.896 and represents a resistance between two opposed sides of a planar resistor of a square shape. Such surface resistance is independent from the dimension of the square as long as the resistance distribution is uniform.

The intermediate transfer belt 409 is supported by a backup roller 408 and a tension roller 407 under a predetermined tension, and is rendered rotatable without slack by the rotation of these rollers. A secondary transfer roller 413 is so positioned as to be in contact with the backup roller 408 across the intermediate transfer belt 409. The intermediate transfer belt 409, after passing a gap between the backup roller 408 and the secondary transfer roller 413, is surface cleaned by a cleaning blade 416 and is used again in a next image forming process.

In a predetermined position in the housing 400, there is provided a tray (transferred image-receiving medium tray) 411, and a transferred image-receiving medium 500 such as paper contained in the tray 411 is transported by a transport roller 412 to the gap between the intermediate transfer belt 409 and the secondary transfer roller 413 and then to a gap between mutually contacted two fixing rollers 414, and is thereafter discharged to the exterior of the housing 400.

Thus, in the course of rotation of the electrophotographic photoreceptors 401*a* to 401*d*, image formation is repeated by executing the steps of charging, exposure, development, transfer and cleaning in succession. The electrophotographic photoreceptors 401*a* to 401*d*, being constituted of the aforementioned electrophotographic photoreceptor 1 having both a leak resistance and electrical characteristics of a high level, can provide a satisfactory image quality without an image defect such as fogging even when used in combination with the contact charging devices 402*a* to 402*d*. Therefore, the present embodiment realizes an image forming apparatus 200 capable of sufficiently avoiding a pinhole leakage in the photoreceptor and forming color images of an excellent image quality at a high speed, even in repeated use over a prolonged period.

The present invention is not limited by the foregoing embodiments.

Also, the image forming apparatus of the invention may be further provided with a charge eliminating device such as an erasing light irradiating device. Such configuration allows to avoid a phenomenon that a residual potential of the electrophotographic photoreceptor is brought into a next cycle in the case where the electrophotographic photoreceptor is used in repetition, thereby enabling to further improve the image quality.

EXAMPLES

The present invention will be illustrated in greater detail and with reference to the following Examples and Comparative Examples, but the invention should not be construed as being limited thereto.

Image forming apparatuses of Examples 1 to 7 and Comparative Examples 1 to 5, having a configuration similar to that of the image forming apparatus 200 shown in FIG. 6, are prepared by following procedures.

Preparation of Electrophotographic Photoreceptor

Electrophotographic photoreceptors, having a configuration similar to that of the electrophotographic photoreceptor 1 shown in FIG. 1, are prepared in the following manner.

At first there are prepared three kinds of laminates, each corresponding to the electrophotographic photoreceptor 1 shown in FIG. 1 but excluding the protective layer 7, by the following procedure. These three kinds of laminates are hereinafter respectively referred to as "base photoreceptor-1", "base photoreceptor-2" and "base photoreceptor-3".

<Base photoreceptor-1>

On an aluminum substrate of an external diameter of 30 mm subjected a honing treatment, a solution constituted of 20 parts by weight of a zirconium compound (trade name: Organotics ZC540, manufactured by Matsumoto Seiyaku Co.), 2.5 parts by weight of a silane compound (trade name: A1100, manufactured by Nippon Unicar Co.), 1.5 parts by weight of polyvinyl butyral resin (trade name: S-LEC B BM-S; manufactured by Sekisui Chemical Co.) and 45 parts by weight of butanol is coated by a dip coating method and heat dried for 10 minutes at 150° C. to obtain an undercoat layer of a thickness of 1.0 μm.

Then a mixture of 15 parts by weight of hydroxygallium phthalocyanine (charge generating material), having diffraction peaks at least at 7.3°, 16.0°, 24.9° and 28.0° in terms of the Bragg angle (2θ±0.2°) of an X-ray diffraction spectrum using CuKα radiation, 10 parts by weight of vinyl chloride-vinyl acetate copolymer resin (VMCH, manufactured by Nippon Unicar Co.) as a binder resin and 300 parts by weight of n-butyl acetate is subjected to a dispersion in a horizontal sand mill with glass beads for 0.5 hours to obtain a coating liquid for the charge generating layer. The obtained coating liquid is dip coated on the undercoat layer mentioned above, and is dried for 10 minutes at 100° C. to obtain a charge generation layer of a thickness of 0.15 μm.

Then, a coating liquid is prepared by dissolving 2 parts by weight of a compound represented by structural formula (i) shown below and 3 parts by weight of a polymer compound represented by structural formula (ii) shown below (viscosity-average molecular weight: 39,000) in a mixed solvent of 15 parts by weight of tetrahydrofuran and 5 parts by weight of chlorobenzene. The obtained coating liquid is coated by a dip coating method on the charge generation layer and is dried with hot air for 40 minutes at 150° C. to obtain a charge transport layer of a thickness of 20 μm. In formula (i), "Me" represents a methyl group.

(i)

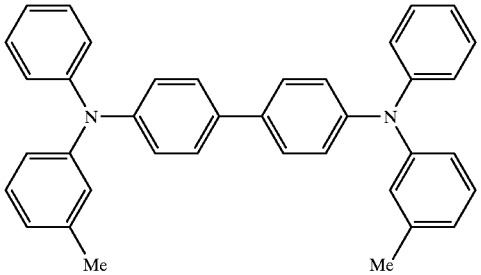

(ii)

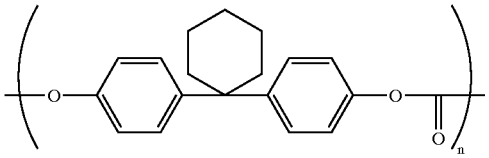

<Base photoreceptor-2>

On an aluminum substrate of an external diameter of 30 mm subjected a honing treatment, a solution constituted of 20 parts by weight of a zirconium compound (trade name: Organotics ZC540, manufactured by Matsumoto Seiyaku Co.), 2.5 parts by weight of a silane compound (trade name: A1100, manufactured by Nippon Unicar Co.), 1.5 parts by weight of polyvinyl butyral resin (trade name: S-LEC B BM-S; manufactured by Sekisui Chemical Co.) and 45 parts by weight of butanol is coated by a dip coating method and heat dried for 10 minutes at 150° C. to obtain an undercoat layer of a thickness of 1.0 μm.

Then a mixture of 15 parts by weight of hydroxygallium phthalocyanine (charge generating material), having diffraction peaks at least at 7.3°, 16.0°, 24.9° and 28.0° in terms of the Bragg angle (2θ±0.2°) of an X-ray diffraction spectrum using CuKα radiation, 10 parts by weight of vinyl chloride-vinyl acetate copolymer resin (VMCH, manufactured by Nippon Unicar Co.) as a binder resin and 300 parts by weight of n-butyl acetate is subjected to a dispersion in a horizontal sand mill with glass beads for 0.5 hours to obtain a coating liquid for the charge generation layer. The obtained coating liquid is dip coated on the undercoat layer mentioned above, and is dried for 10 minutes at 100° C. to obtain a charge generation layer of a thickness of 0.15 μm.

Then, a coating liquid is prepared by dissolving 2 parts by weight of a compound represented by structural formula (iii) shown below and 3 parts by weight of a polymer compound represented by the foregoing structural formula (ii) (viscosity-average molecular weight: 39,000) in a mixed solvent of 15 parts by weight of tetrahydrofuran and 5 parts by weight of chlorobenzene. The obtained coating liquid is coated by a dip coating method on the charge generation layer and is dried with hot air for 40 minutes at 135° C. to obtain a charge transport layer of a thickness of 17 μm. In formula (iii), "Me" represents a methyl group.

(iii)

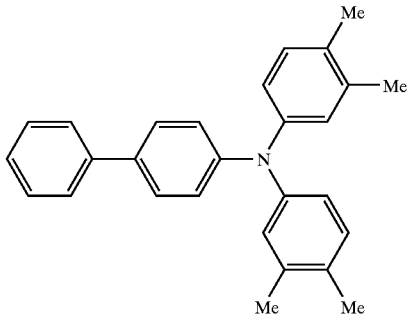

<Base photoreceptor-3>

100 parts by weight of zinc oxide (average particle size: 70 nm, a trial product by Teika Co.) are mixed under agitation with 500 parts by weight of toluene, and an obtained mixture is further added with 1.5 parts by weight of a silane coupling agent (KBM603, manufactured by Shin-etsu Chemical Co.) and is agitated for 2 hours. Thereafter toluene is removed by distillation under a reduced pressure, and a sintering is carried out for 2 hours at 150° C. to apply a surface treatment on the zinc oxide particles.

A solution is prepared by dissolving 60 parts by weight of thus obtained zinc oxide particles, 15 parts by weight of a hardening agent (block isocyanate, trade name: Sumidur 3175, manufactured by Sumitomo-Bayer Urethane Co.) and 15 parts by weight of a butyral resin (trade name: S-LEC B BM-1, manufactured by Sekisui Chemical Co.) in 85 parts by weight of methyl ethyl ketone. Then, 38 parts by weight of this solution and 25 weight by part of methyl ethyl ketone are mixed and are dispersed for 2 hours in a sand mill with glass beads of a diameter of 1 mm to obtain a dispersion liquid. Then 0.005 parts by weight of dioctyl tin laurate as a catalyst and 3.4 parts by weight of silicone resin particles (Tospearl, manufactured by GE-Toshiba Silicone Co.) are added to the obtained dispersion thereby obtaining a coating liquid for forming an undercoat layer. This coating liquid is dip coated on an aluminum substrate of a diameter of 30 mm, a length of 340 mm and a thickness of 1 mm and is dried and cured for 100 minutes at 160° C. to obtain an undercoat layer of a thickness of 20 μm.

Then a mixture of 15 parts by weight of hydroxygallium phthalocyanine (charge generating material), having diffraction peaks at least at 7.3°, 16.0°, 24.9° and 28.0° in terms of the Bragg angle (2θ±0.2°) of an X-ray diffraction spectrum using CuKα radiation, 10 parts by weight of vinyl chloride-vinyl acetate copolymer resin (VMCH, manufactured by Nippon Unicar Co.) as a binder resin and 300 parts by weight of n-butyl acetate is subjected to a dispersion in a horizontal sand mill with glass beads for 0.5 hours to obtain a coating liquid for the charge generation layer. The obtained coating liquid is dip coated on the undercoat layer mentioned above, and is dried for 10 minutes at 100° C. to obtain a charge generation layer of a thickness of 0.15 μm.

Then, a coating liquid is prepared by dissolving 2 parts by weight of a compound represented by the foregoing structural formula (i) and 3 parts by weight of a polymer compound represented by the foregoing structural formula (ii) (viscosity-average molecular weight: 39,000) in a mixed solvent of 15 parts by weight of tetrahydrofuran and 5 parts by weight of chlorobenzene. The obtained coating liquid is coated by a dip coating method on the charge generation layer and is dried with hot air for 40 minutes at 135° C. to obtain a charge transport layer of a thickness of 20 μm.

<Base photoreceptor-4>

A base photoreceptor is prepared in the same manner as the base photoreceptor-1 except that the charge transport layer is prepared with a thickness of 30 μm.

<Base photoreceptor-5>

A base photoreceptor is prepared in the same manner as the base photoreceptor-2 except that the charge transport layer is prepared with a thickness of 25 μm.

<Base photoreceptor-6>

A base photoreceptor is prepared in the same manner as the base photoreceptor-2 except that the charge transport layer is prepared with a thickness of 30 μm.

<Base photoreceptor-7>

A base photoreceptor is prepared in the same manner as the base photoreceptor-2 except that the charge transport layer is prepared with a thickness of 35 μm.

Then there are prepared two kinds of coating liquids for forming a protective layer, by the following procedure. These two kinds of coating liquids for forming the protective layer are hereinafter respectively referred to as "protective layer coating liquid-1" and "protective layer coating liquid-2".

<Protective Layer Coating Liquid-1>

2 parts by weight each of compounds represented by following structural formulas (iv) and (v) are dissolved in a mixture of 5 parts by weight of isopropyl alcohol, 3 parts by weight of tetrahydrofuran and 0.3 parts by weight of distilled water and, after an addition of 0.05 parts by weight of an ion exchange resin (trade name: Amberlist 15E, manufactured by Rhom & Hass Co.), are subjected to a hydrolysis for 24 hours under agitation. In formulas (iv) and (v), "Me" represents a methyl group.

(iv)

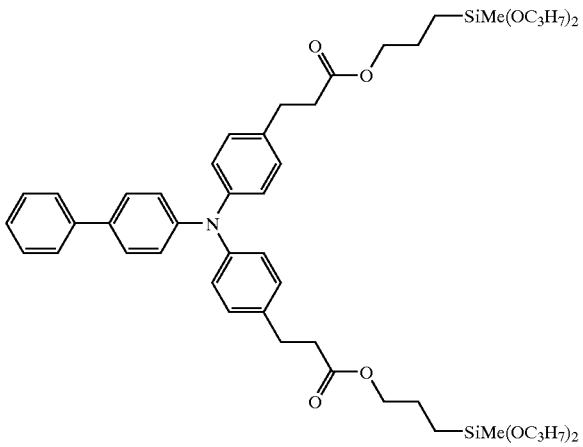

-continued (v)

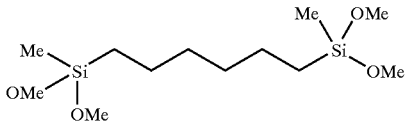

Then, from the liquid obtained after the hydrolysis, the ion exchange resin is separated by filtration. Then 0.04 parts by weight of aluminum trisacetylactonate are added to 2 parts by weight of the obtained liquid to obtain a protective layer coating liquid-1.

<Protective Layer Coating Liquid-2>

A protective layer coating liquid-2 is prepared in the same procedure conditions as in the protective layer coating liquid-1, except that the compound represented by the foregoing formula (iv) is replaced by a compound represented by formula (vi) shown below, that the compound represented by the foregoing formula (v) is replaced by a compound represented by formula (vii) shown below, and that 1 part by weight of polyvinyl butyral resin (trade name S-LEC B BX-L, manufactured by Sekisui Chemical Co.) is added in addition to the components of the protective layer coating liquid-1. In formulas (vi) and (vii), "Me" represents a methyl group.

(vi)

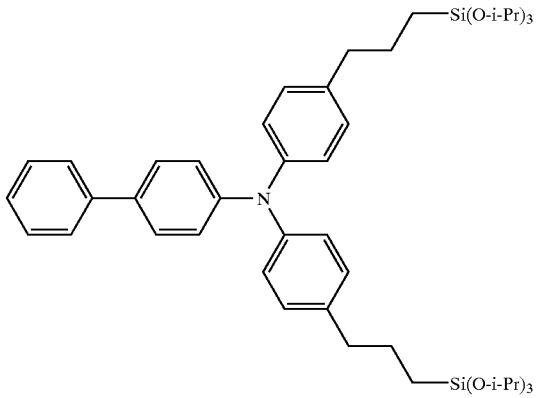

(vii)

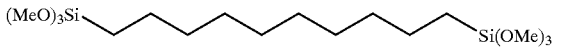

Example 1

Preparation of Photoreceptor

On the base photoreceptor-1 (having a photosensitive layer of a thickness of 20 μm), the protective layer coating liquid-1 is coated by a ring-type dip coating method, then air dried for 10 minutes at the room temperature and heat cured for 40 minutes at 140° C. to form a protective layer (thickness: 5 μm), thereby obtaining an electrophotographic photoreceptor.

Preparation of Image Forming Apparatus

The obtained electrophotographic photoreceptor is utilized for preparing a tandem-type image forming apparatus employing a charging device of contact charging type and a transfer method of intermediate transfer type. The image forming apparatus has the same configuration as that of the color tandem copying machine DocuCentre C400 (manufactured by Fuji-Xerox Co.) except that the exposure device is modified to the following configuration. The exposure device is provided with a surface emitting laser array (light emission points in a two-dimensional arrangement of 6×6, laser beams of a number m=32), and a scanning line density is modified to 2400 dpi (The term "dpi" means dot per inch).

In the foregoing explanation, whereas the surface emitting laser array has light emitting points in a two-dimensional arrangement of 6×6, namely 36 elements arrayed in a 6×6 matrix, the number of the laser beams is 32 rather than 36 because it is restricted by a control condition of a computer, requiring an n-th power of 2 ($2^5$ in this case).

Example 2

An image forming apparatus is prepared in the same manner as in the Example 1, except that the protective layer coating liquid-2 is coated, on the base photoreceptor-1 (having a photosensitive layer of a thickness of 20 μm), by a ring-type dip coating method, then air dried for 10 minutes at the room temperature and heat cured for 40 minutes at 140° C. to form a protective layer (thickness: 3 μm), thereby providing an electrophotographic photoreceptor.

Example 3

An image forming apparatus is prepared in the same manner as in the Example 1, except that the protective layer coating liquid-1 is coated, on the base photoreceptor-2 (having a photosensitive layer of a thickness of 17 μm), by a ring-type dip coating method, then air dried for 10 minutes at the room temperature and heat cured for 40 minutes at 140° C. to form a protective layer (thickness: 3 μm), thereby providing an electrophotographic photoreceptor.

Example 4

An image forming apparatus is prepared in the same manner as in the Example 1, except that the protective layer coating liquid-2 is coated, on the base photoreceptor-2 (having a photosensitive layer of a thickness of 17 μm), by a ring-type dip coating method, then air dried for 10 minutes at the room temperature and heat cured for 40 minutes at 140° C. to form a protective layer (thickness: 2 μm), thereby providing an electrophotographic photoreceptor.

Example 5

An image forming apparatus is prepared in the same manner as in the Example 1, except that the protective layer coating liquid-1 is coated, on the base photoreceptor-3 (having a photosensitive layer of a thickness of 20 μm), by a ring-type dip coating method, then air dried for 10 minutes at the room temperature and heat cured for 40 minutes at 140° C. to form a protective layer (thickness: 5 μm), thereby providing an electrophotographic photoreceptor.

Example 6

An image forming apparatus is prepared in the same manner as in the Example 1, except that the protective layer coating liquid-2 is coated, on the base photoreceptor-3 (having a photosensitive layer of a thickness of 20 μm), by a ring-type dip coating method, then air dried for 10 minutes at the room temperature and heat cured for 40 minutes at 140° C. to form a protective layer (thickness: 3 μm), thereby providing an electrophotographic photoreceptor.

Comparative Example 1

An image forming apparatus is prepared in the same manner as in the Example 1, except that the base photoreceptor-5 (having a photosensitive layer of a thickness of 25 μm) is employed, without forming the protective layer thereon, as an electrophotographic photoreceptor.

Comparative Example 2

An image forming apparatus is prepared in the same manner as in the Example 1, except that the base photoreceptor-6 (having a photosensitive layer of a thickness of 30 μm) is employed, without forming the protective layer thereon, as an electrophotographic photoreceptor.

Comparative Example 3

An image forming apparatus is prepared in the same manner as in the Example 1, except that the base photoreceptor-7 (having a photosensitive layer of a thickness of 35 μm) is employed, without forming the protective layer thereon, as an electrophotographic photoreceptor.

Comparative Example 4

An electrophotographic photoreceptor is prepared in the same manner as in the Example 1. Then an image forming apparatus is prepared by mounting it on a machine DCC400, manufactured by Fuji-Xerox Co. (with 2 beams in a surface emitting laser in the exposure device and with a scan density of 1200×600 dpi) and not subjected the modification in the Example 1.

Comparative Example 5

An image forming apparatus is prepared in the same manner as in the Comparative Example 4, except that the base photoreceptor-1 (having a photosensitive layer of a thickness of 30 μm) is employed, without forming the protective layer thereon, as an electrophotographic photoreceptor.

Performance Evaluation Test of Image Forming Apparatus

On each of the image forming apparatuses of Examples 1 to 6 and Comparative Examples 1 to 5, performance is evaluated in the following manner.

In an environment of a high temperature and a high humidity (28° C., 85% RH), an image forming process constituted of following steps (a) to (c) as a cycle is repeated by 400,000 cycles (400,000 times) to continuously print images on papers (400,000 sheets). For such paper, there is employed a PPC paper (L, A4 size) manufactured by Fuji-Xerox Co.

(a) Each electrophotographic photoreceptor is charged with a scorotron charger with a grid potential of −700 V; (b) A semiconductor laser of a wavelength of 780 nm is employed to irradiate each electrophotographic photoreceptor, after 1 second from the charging in the step (a), with a light of 10 mJ/$m^2$ to carry out a charge dissipation; and (c) after 3 seconds from the charge dissipation, each electrophotographic photoreceptor is irradiated with a light of a red LED of 50 mJ/$m^2$ to carry out a charge elimination.

For each image forming apparatus, there are measured a potential A (V) on each electrophotographic photoreceptor after 1 cycle (after the step (c)) and a potential B (V) on each electrophotographic photoreceptor after 400,000 cycles (after the step (c)), and a variation (B−A) is calculated. Also the average of the variations (B−A) is calculated for each image forming apparatus.

Also for each image forming apparatus, there are measured an initial thickness of each electrophotographic photoreceptor and a thickness of each electrophotographic photoreceptor after 400,000 cycles, and there is calculated a "thickness of photoreceptor decreased by abrasion" (hereinafter referred to as "abrasion amount"). Also based on such abrasion amount, an abrasion rate (nm/Kcycle) is calculated for each electrophotographic photoreceptor. Further, an average of the abrasion rates is calculated for each image forming apparatus.

For the photoreceptor in each image forming apparatus, with respect to a sample having a surface protective layer, a lifetime is defined by a period until the surface protective layer is abraded off. With respect to a sample of which surface is constituted by the charge transport layer without the addition of a surface protective layer, a lifetime is defined at a time when a remaining thickness of the charge transport layer reaches 12 to 13 μm. This corresponds to a limit of a practically acceptable level since a further decrease in the layer thickness results in a potential fluctuation by abrasion and a fog, etc. in the image quality. A cycle of the steps (a) to (c) is repeated, and the number of cycles (Kcycle) required for reaching the aforementioned level is measured as "photoreceptor lifetime".

The results of the aforementioned measurements are shown in Table 2.

TABLE 2

| | | | Evaluation after 400,000 prints (400 kcycles) | | | | | |
|---|---|---|---|---|---|---|---|---|
| | | | | Abrasion of photoreceptor | | | | |
| Light source | Scan line recording density | | Resolution of latent image on photoreceptor | Abrasion rate (nm/kcycle) | photoreceptor life-time (Kcycle) | Abrasion amount (μm) | Abrasion amount/abrasion rate (kcycle) | Variation of surface potential of photoreceptor (increase, V) |
| Surface emitting laser array (6 × 6, 32 beams) | 2400 × 2400 | Example 1 | ca. 2400 | 3.5 | >1000 | 5 | 1428 | ca. 35 |
| | | Example 2 | ca. 2400 | 2.0 | >1000 | 3 | 1500 | ca. 50 |
| | | Example 3 | ca. 2400 | 2.5 | >1000 | 3 | 1200 | ca. 30 |
| | | Example 4 | ca. 2400 | 1.9 | >1000 | 2 | 1053 | ca. 60 |
| | | Example 5 | ca. 2400 | 3.5 | >1000 | 5 | 1428 | ca. 40 |
| | | Example 6 | ca. 2400 | 2.0 | >1000 | 3 | 1500 | ca. 65 |
| | | Comp. Ex. 1 | ca. 2400 | 46.0 | ca. 260 | 12 | 261 | ca. 200 |
| | | Comp. Ex. 2 | ca. 2400 | 50.0 | ca. 340 | 17 | 340 | ca. 210 |
| | | Comp. Ex. 3 | ca. 2400 | 51.0 | ca. 430 | 22 | 431 | ca. 200 |
| Prior light source (2beams) | 1200 × 600 | Comp. Ex. 4 | ca. 600 | 3.5 | >1000 | 5 | 1428 | ca. 35 |
| | | Comp. Ex. 5 | ca. 600 | 52.0 | ca. 340 | 17.5 | 337 | ca. 210 |

As explained in the foregoing, the image forming apparatus of the invention, even in the case of employing a surface emitting laser array as a light source of the exposure device, can easily achieve an improvement in the image quality, an increase in the image forming speed and a downsized configuration and can provide images of a satisfactory quality even after repeating the image forming process over a prolonged period.

While the invention has been described in detail and with reference to specific embodiments thereof, it will be apparent to one skilled in the art that various changes and modifications can be made therein without departing from the spirit and scope thereof.

This application is based on Japanese Application No. 2003-78972 filed Mar. 20, 2003, the contents thereof being herein incorporated by reference.

What is claimed is:

1. An image forming apparatus comprising at least:

an electrophotographic photoreceptor comprising at least a conductive substrate and a photosensitive layer provided on said conductive substrate;

a charging device for charging said electrophotographic photoreceptor;

an exposure device for exposing said electrophotographic photoreceptor charged by said charging device to light thereby forming an electrostatic latent image;

a developing device for developing said electrostatic latent image with toner thereby forming a toner image; and a transfer device for transferring said toner image from said electrophotographic photoreceptor to a transferred image-receiving medium, wherein said exposure device is of a multi beam exposure system which has a surface emitting laser array having two or more light-emitting elements as an exposure light source and which scan said electrophotographic photoreceptor with plural light beams thereby forming said electrostatic latent image, and wherein the outermost layer in said electrophotographic photoreceptor, positioned most distant from said conductive substrate, contains a silicon-containing resin containing at least a charge transporting compound or a characteristic group derived from a charge transporting compound, and having a structure in which bonds formed by crosslinking of an O atom with neighboring Si atoms are formed three dimensionally.

2. The image forming apparatus according to claim 1, wherein said outermost layer in said electrophotographic photoreceptor is formed by said silicon-containing resin.

3. The image forming apparatus according to claim 1, wherein said silicon-containing resin comprises at least one resin represented by the following general formula (1):

$$F^1[—D^1—Si(OR^2)_a(R^1)_{3-a}]_b \quad (1)$$

wherein $F^1$ represents an organic group derived from a charge transporting compound; $D^1$ represents a divalent group; $R^1$ represents one selected from the group consisting of a hydrogen atom, an alkyl group and a substituted or unsubstituted aryl group; $R^2$ represents one selected from the group consisting of a hydrogen atom, an alkyl group and a trialkylsilyl group; a represents an integer from 1 to 3; and b represents an integer from 1 to 4.

4. The image forming apparatus according to claim 1, wherein said surface emitting laser array has light emitting points arranged two dimensionally.

5. The image forming apparatus according to claim 1, wherein said exposure device causes three or more light beams to independently scan said electrophotographic photoreceptor.

6. The image forming apparatus according to claim 1, having two or more image forming units each including at least said charging device, said exposure device and said developing device.

7. The image forming apparatus according to claim 1, wherein said charging device is a contact charging device which charges said electrophotographic photoreceptor in contact therewith.

8. The image forming apparatus according to claim 1, wherein said transfer device is of an intermediate transfer system which transfers said toner image to said transferred image-receiving medium through an intermediate transfer member.

9. The image forming apparatus according to claim 1, wherein said photoreceptor further comprises an undercoat layer which is provided between said conductive substrate and said photosensitive layer.

10. An image forming apparatus comprising at least:

an electrophotographic photoreceptor comprising at least a conductive substrate and a photosensitive layer provided on said conductive substrate;

a charging device for charging said electrophotographic photoreceptor;

an exposure device for exposing said electrophotographic photoreceptor charged by said charging device to light thereby forming an electrostatic latent image;

a developing device for developing said electrostatic latent image with toner thereby forming a toner image; and a transfer device for transferring said toner image from said electrophotographic photoreceptor to a transferred image-receiving medium, wherein said exposure device is a multi beam exposure which scans said electrophotographic photoreceptor with plural light beams thereby forming said electrostatic latent image, and wherein the outermost layer in said electrophotographic photoreceptor, positioned most distant from said conductive substrate, has an abrasion rate of 5 nm/kcycle or less.

11. The image forming apparatus according to claim 10, wherein said outermost layer in said electrophotographic photoreceptor contains a silicon-containing resin containing at least a charge transporting compound or a characteristic group derived from a charge transporting compound and having a structure in which bonds formed by crosslinking of an O atom with neighboring Si atoms are formed three dimensionally.

12. The image forming apparatus according to claim 11, wherein said outermost layer in said electrophotographic photoreceptor is formed by said silicon-containing resin.

13. The image forming apparatus according to claim 11, wherein said silicon-containing resin comprises at least one resin represented by the following general formula (1):

$$F^1[—D^1—Si(OR^2)_a(R^1)_{3-a}]_b \quad (1)$$

wherein $F^1$ represents an organic group derived from a charge transporting compound; $D^1$ represents a divalent group; $R^1$ represents one selected from the group consisting of a hydrogen atom, an alkyl group and a substituted or unsubstituted aryl group; $R^2$ represents one selected from the group consisting of a hydrogen atom, an alkyl group and a trialkylsilyl group; a represents an integer from 1 to 3; and b represents an integer from 1 to 4.

14. The image forming apparatus according to claim 10, wherein said exposure device is of a multi beam exposure system which has a surface emitting laser array having two or more light-emitting elements as an exposure light source, wherein said surface emitting laser array has light emitting points arranged two dimensionally.

15. The image forming apparatus according to claim 10, wherein said exposure device causes three or more light beams to independently scan said electrophotographic photoreceptor.

16. The image forming apparatus according to claim 11, wherein said photosensitive layer comprises at least a charge generation layer containing a charge generating substance, and a charge transport layer containing a charge transport material, wherein said photoreceptor further comprises a protective layer which is formed by said silicon-containing resin and which is provided as said outermost layer on said photosensitive layer, and wherein the sum of the thickness of said photosensitive layer and the thickness of said protective layer is 25 $\mu$m or less.

17. The image forming apparatus according to claim 10, having two or more image forming units each including at least said charging device, said exposure device and said developing device.

18. The image forming apparatus according to claim 10, wherein said charging device is a contact charging device which charges said electrophotographic photoreceptor in contact therewith.

19. The image forming apparatus according to claim 10, wherein said transfer device is of an intermediate transfer system which transfers said toner image to said transferred image-receiving medium through an intermediate transfer member.

20. The image forming apparatus according to claim 10, wherein said photoreceptor further comprises an undercoat layer which is provided between said conductive substrate and said photosensitive layer.

* * * * *